US010870274B2

(12) United States Patent
Tsukahara et al.

(10) Patent No.: US 10,870,274 B2
(45) Date of Patent: Dec. 22, 2020

(54) LIQUID EJECTING HEAD AND LIQUID EJECTING APPARATUS

(71) Applicant: SEIKO EPSON CORPORATION, Tokyo (JP)

(72) Inventors: Katsutomo Tsukahara, Shiojiri (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/473,203

(22) PCT Filed: Dec. 7, 2017

(86) PCT No.: PCT/JP2017/043977
§ 371 (c)(1),
(2) Date: Jun. 24, 2019

(87) PCT Pub. No.: WO2018/116846
PCT Pub. Date: Jun. 28, 2018

(65) Prior Publication Data

US 2019/0366717 A1 Dec. 5, 2019

(30) Foreign Application Priority Data

Dec. 22, 2016 (JP) ..... 2016-249118
Feb. 15, 2017 (JP) ..... 2017-026372

(51) Int. Cl.
*B41J 2/14* (2006.01)
*B41J 2/18* (2006.01)

(52) U.S. Cl.
CPC ..... *B41J 2/14* (2013.01); *B41J 2/14233* (2013.01); *B41J 2/18* (2013.01); *B41J 2002/14411* (2013.01)

(58) Field of Classification Search
CPC ..... B41J 2/14; B41J 2/14233; B41J 2/18
See application file for complete search history.

(56) References Cited

U.S. PATENT DOCUMENTS

2008/0198208 A1 8/2008 Kyoso et al.
2011/0148988 A1 6/2011 Hoisington et al.
2011/0234705 A1* 9/2011 Fukada ..... B41J 2/14274 347/68

(Continued)

FOREIGN PATENT DOCUMENTS

JP 2008-200902 9/2008
JP 2011-520671 7/2011

(Continued)

*Primary Examiner* — Jason S Uhlenhake
(74) *Attorney, Agent, or Firm* — Workman Nydegger

(57) ABSTRACT

In a liquid ejecting head, a reduction in mechanical strength due to a liquid chamber provided to circulate a liquid is limited.

The liquid ejecting head includes: a nozzle plate provided with a nozzle; a flow channel forming unit provided with a pressure chamber to which a liquid is supplied, a communication channel through which the nozzle and the pressure chamber communicate with each other, and a circulating liquid chamber communicating with the communication channel; and a pressure generating unit that generates a pressure change in the pressure chamber. A height at a first location in the circulating liquid chamber is larger than a height at a second location on a side of the communication channel when viewed from the first location.

20 Claims, 17 Drawing Sheets

(56) References Cited

U.S. PATENT DOCUMENTS

| | | | | |
|---|---|---|---|---|
| 2012/0176450 | A1 | 7/2012 | Akahane et al. | |
| 2014/0036001 | A1 * | 2/2014 | Hoisington | B41J 2/14 347/54 |

FOREIGN PATENT DOCUMENTS

| | | | | |
|---|---|---|---|---|
| JP | 2011-218784 | | 11/2011 | |
| JP | 2012-143948 | | 8/2012 | |
| JP | 2012143948 | A * | 8/2012 | B41J 2/14233 |

* cited by examiner

LIQUID EJECTING HEAD AND LIQUID EJECTING APPARATUS

CROSS REFERENCE TO RELATED APPLICATIONS

This application is a U.S. Nationalization of PCT Application Number PCT/JP2017/043977, filed on Dec. 7, 2017, which claims priority to JP Patent Application No. 2016-2419118, filed Dec. 22, 2016, and JP Patent Application No. 2017-026372, filed Feb. 15, 2017, the entireties of which are incorporated herein by reference.

TECHNICAL FIELD

The present invention relates to a technology of ejecting a liquid such as ink.

BACKGROUND ART

In the related, there is proposed a liquid ejecting head that ejects a liquid such as ink from a plurality of nozzles. For example, PTL 1 discloses a liquid ejecting head having a stacking structure in which a flow channel forming substrate is disposed on a front surface of a communication plate on one side, and a nozzle plate is disposed on a front surface thereof on the other side. The flow channel forming substrate is provided with a pressure generating chamber that is filled with a liquid which is supplied from a common liquid chamber (reservoir), and the nozzle plate is provided with a nozzle. The pressure generating chamber and the nozzle communicate with each other via a communication channel formed in the communication plate. The front surface of the communication plate, on which the nozzle plate is disposed, is provided with a circulation flow channel, which communicates with the common liquid chamber, and a groove-shaped circulating communication channel through which the communication channel and the circulation flow channel communicate with each other. According to the configuration described above, it is possible to circulate a liquid inside the communication channel to the common liquid chamber via the circulating communication channel and the circulation flow channel.

CITATION LIST

Patent Literature

PTL 1: Japanese Unexamined Patent Application Publication No. 2012-143948

SUMMARY OF INVENTION

Technical Problem

In a technology in PTL 1, the circulating communication channel is formed in the communication plate, and thus it is difficult to sufficiently ensure mechanical strength of the communication plate. With consideration for such circumstances described above, one of objects of a preferred aspect of the present invention is to limit a reduction in mechanical strength due to a liquid chamber provided to circulate a liquid.

Solution to Problem

Aspect A1

In order to solve such a problem described above, according to a preferred aspect (aspect A1) of the present invention, there is provided a liquid ejecting head including: a nozzle plate provided with a nozzle; a flow channel forming unit provided with a pressure chamber to which a liquid is supplied, a communication channel through which the nozzle and the pressure chamber communicate with each other, and a circulating liquid chamber communicating with the communication channel; and a pressure generating unit that generates a pressure change in the pressure chamber. A height at a first location in the circulating liquid chamber is larger than a height at a second location on a side of the communication channel when viewed from the first location. In the aspect described above, since the height at the first location in the circulating liquid chamber is larger than the height at the second location on the side of the communication channel when viewed from the first location, it is possible to more limit a reduction in mechanical strength of the flow channel forming unit than in a configuration in which the entire circulating liquid chamber has the same height as that at the first location.

Aspect A2

In a preferred example (aspect A2) according to the aspect A1, the circulating liquid chamber may not overlap the pressure chamber in a plan view. In the aspect described above, since the circulating liquid chamber does not overlap the pressure chamber, it is possible to more limit a reduction in mechanical strength of the flow channel forming unit than in a configuration in which the circulating liquid chamber overlaps the pressure chamber.

Aspect A3

In a preferred example (aspect A3) according to the aspect A1 or A2, a maximum value of the height of the circulating liquid chamber may be smaller than a flow channel length of the communication channel. In the aspect described above, the maximum value of the height of the circulating liquid chamber is smaller than the flow channel length of the communication channel. Hence, it is possible to more limit a reduction in mechanical strength of the flow channel forming unit than in a configuration in which the maximum value of the height of the circulating liquid chamber is equal to or larger than the flow channel length of the communication channel.

Aspect A4

In a preferred example (aspect A4) according to the aspect A1 or A2, the flow channel forming unit may have a first flow channel substrate provided with the communication channel and the circulating liquid chamber and a second flow channel substrate provided with the pressure chamber, and a maximum value of the height of the circulating liquid chamber may be equal to or smaller than a half of a thickness of the first flow channel substrate. In the aspect described above, the maximum value of the height of the circulating liquid chamber is equal to or smaller than a half of the thickness of the first flow channel substrate. Hence, it is possible to more limit a reduction in mechanical strength of the flow channel forming unit than in a configuration in which the maximum value of the height of the circulating liquid chamber is larger than a half of the thickness of the first flow channel substrate.

Aspect A5

In a preferred example (aspect A5) according to any one of the aspects A1 to A4, a maximum value of the height of the circulating liquid chamber may be smaller than a width of the circulating liquid chamber. In the aspect described above, the maximum value of the height of the circulating liquid chamber is smaller than the width of the circulating liquid chamber. Hence, it is possible to more limit a reduction in mechanical strength of the flow channel forming unit than in a configuration in which the maximum value of the height of the circulating liquid chamber is larger than the width.

Aspect A6

In a preferred example (aspect A6) according to any one of the aspects A1 to A5, the height of the circulating liquid chamber may monotonically decrease from a position at which the height is maximum to an end portion of the circulating liquid chamber in a width direction. In the aspect described above, since the height monotonically decreases from the position, at which the circulating liquid chamber has the maximum height, to the end portion in the width direction, it is possible to more limit a reduction in mechanical strength of the flow channel forming unit.

Aspect A7

In a preferred example (aspect A7) according to any one of the aspects A1 to A6, the circulating liquid chamber may have an upper surface provided with a plurality of grooves extending into a curved shape in a plan view. In the aspect described above, since the circulating liquid chamber has the upper surface provided with the plurality of curved grooves, it is possible to adjust a direction, in which a liquid flows in the circulating liquid chamber, by the plurality of grooves.

Aspect A8

In a preferred example (aspect A8) according to the aspect A7, the circulating liquid chamber may elongate in a first direction, and the plurality of grooves may have a convex shape on a first side in the first direction in a plan view. In the aspect described above, the plurality of grooves have the convex shape on the first side in the first direction. Hence, it is possible to easily cause the liquid flowing into the circulating liquid chamber to flow toward a second side opposite to the first side.

Aspect A9

In a preferred example (aspect A9) according to the aspect A7, the nozzle plate may be provided with a first nozzle and a second nozzle as the nozzle, and the flow channel forming unit may be provided with the pressure chamber and the communication channel corresponding to the first nozzle, the pressure chamber and the communication channel corresponding to the second nozzle, and the circulating liquid chamber that is positioned between the communication channel corresponding to the first nozzle and the communication channel corresponding to the second nozzle and that elongates in the first direction. The grooves formed in a region of the upper surface of the circulating liquid chamber on a side of the first nozzle may have a convex shape on a first side in the first direction, and the grooves formed in a region on a side of the second nozzle may have a convex shape on a second side opposite to the first side in a plan view. In the aspect described above, an advantage is achieved in that it is easy to cause the liquid flowing into the circulating liquid chamber from the communication channel corresponding to the first nozzle to flow toward the second side in the first direction, and it is easy to cause the liquid flowing into the circulating liquid chamber from the communication channel corresponding to the second nozzle to flow toward the first side in the first direction.

Aspect A10

In a preferred example (aspect A10) according to the aspect A7, the nozzle plate may be provided with a first nozzle and a second nozzle as the nozzle, and the flow channel forming unit may be provided with the pressure chamber and the communication channel corresponding to the first nozzle, the pressure chamber and the communication channel corresponding to the second nozzle, and the circulating liquid chamber that is positioned between the communication channel corresponding to the first nozzle and the communication channel corresponding to the second nozzle and that elongates in the first direction. The grooves formed in a region of the upper surface of the circulating liquid chamber on a side of the first nozzle and the grooves formed in a region on a side of the second nozzle may have a convex shape on a first side in the first direction in a plan view. In the aspect described above, an advantage is achieved in that it is easy to cause both the liquid flowing into the circulating liquid chamber from the communication channel corresponding to the first nozzle and the liquid flowing into the circulating liquid chamber from the communication channel corresponding to the second nozzle to flow toward the second side opposite to the first side.

Aspect A11

In a preferred example (aspect A11) according to the aspect A7, the nozzle plate may be provided with a plurality of nozzles arranged in the first direction, and the flow channel forming unit may be provided with the pressure chamber and the communication channel corresponding to each of the plurality of nozzles and the circulating liquid chamber elongating in the first direction. Grooves of the plurality of grooves which are positioned on a first side in the first direction may have a convex shape on a second side opposite to the first side in a plan view, and grooves of the plurality of grooves on the second side in the first direction may have a convex shape on the first side in a plan view. In the aspect described above, an advantage is achieved in that it is easy to cause the liquid flowing into the circulating liquid chamber from the nozzle positioned on the first side in the first direction to flow toward the first side, and it is easy to cause the liquid flowing into the circulating liquid chamber from the nozzle positioned on the second side in the first direction to flow toward the second side.

Aspect A12

In a preferred example (aspect A12) according to any one of the aspects A1 to A11, the flow channel forming unit may be provided with a first circulating liquid chamber and a second circulating liquid chamber as the circulating liquid chamber, which are positioned on opposite sides of each other with the communication channel interposed therebetween and which communicate with the communication channel. In the aspect described above, since the first circulating liquid chamber and the second circulating liquid chamber are positioned on opposite sides of each other with the communication channel interposed therebetween, it is possible to more increase a circulation amount of the liquid than in a configuration in which only one of the first circulating liquid chamber and the second circulating liquid chamber is provided.

Aspect A13

In a preferred example (aspect A13) according to the aspect A12, the first circulating liquid chamber may not overlap the pressure chamber in a plan view, but the second circulating liquid chamber may overlap the pressure chamber in a plan view. In the aspect described above, since the first circulating liquid chamber does not overlap the pressure chamber, but the second circulating liquid chamber overlaps the pressure chamber, an advantage is achieved in that it is easier to maintain the mechanical strength of the pressure chamber than in a configuration in which both the first circulating liquid chamber and the second circulating liquid chamber overlap the pressure chamber.

Aspect A14

In a preferred example (aspect A14) according to the aspect A13, a height of the first circulating liquid chamber may be equal to a height of the second circulating liquid chamber. According to the aspect described above, an advantage is achieved in that a process of forming the first circulating liquid chamber and the second circulating liquid chamber is simplified.

Aspect A15

In a preferred example (aspect A15) according to the aspect A13, a height of the first circulating liquid chamber may be larger than a height of the second circulating liquid chamber. According to the aspect described above, an advantage is achieved in that it is easy to maintain the mechanical strength of the pressure chamber.

Aspect A16

In a preferred example (aspect A16) according to the aspect A13, a height of the first circulating liquid chamber may be smaller than a height of the second circulating liquid chamber. According to the aspect described above, an advantage is achieved in that it is easy to maintain the mechanical strength of the flow channel forming unit.

Aspect A17

In a preferred example (aspect A17) according to the aspect A13, a width of the first circulating liquid chamber may be larger than a width of the second circulating liquid chamber.

Aspect A18

In a preferred example (aspect A18) according to the aspect A13, a width of the first circulating liquid chamber may be smaller than a width of the second circulating liquid chamber.

Aspect A19

In a preferred example (aspect A19) according to any one of the aspects A1 to A18, the flow channel forming unit may be provided with a liquid supply chamber that stores a liquid that is to be supplied to the pressure chamber, and the maximum value of the height of the circulating liquid chamber may be equal to a height of the liquid supply chamber. According to the aspect described above, since the height of the circulating liquid chamber is equal to the height of the liquid supply chamber, an advantage is achieved in that a process of forming the circulating liquid chamber and the liquid supply chamber is simplified.

Aspect A20

In a preferred example (aspect A20) according to any one of the aspects A1 to A19, a partition wall having a predetermined thickness may be provided between the circulating liquid chamber and the communication channel. In the aspect described above, since the partition wall having the predetermined thickness is provided between the circulating liquid chamber and the communication channel, an advantage is achieved in that it is easy to maintain the mechanical strength of the circulating liquid chamber.

Aspect A21

In a preferred example (aspect A21) according to any one of the aspects A1 to A20, the circulating liquid chamber may have a first space and a second space formed between flow channel walls, which are opposite to each other, on a side of the communication channel when viewed from the first space. The first location may be positioned within the first space, and the second location may be positioned within the second space. In the aspect described above, since the second space of the circulating liquid chamber is formed between the flow channel walls, an advantage is achieved in that it is easier to maintain the mechanical strength of the flow channel forming unit than in a configuration in which the flow channel walls are not formed.

Aspect A22

In a preferred example (aspect A22) according to any one of the aspects A1 to A21, the liquid ejecting head may further include a wiring substrate having an end portion disposed on an opposite side of the nozzle plate with the flow channel forming unit interposed therebetween, and the circulating liquid chamber may overlap the end portion of the wiring substrate in a plan view. In the aspect described above, an external force is easy to be applied to the flow channel forming unit from the delivery substrate during installation of the wiring substrate. Hence, it is particularly preferable to employ the aspect described above in which it is possible to limit a reduction in mechanical strength of the flow channel forming unit.

Aspect A23

According to another preferred aspect (aspect A23) of the present invention, there is provided a liquid ejecting apparatus including the liquid ejecting head according to any one of the aspects exemplified above. A preferable example of the liquid ejecting apparatus is a printing apparatus that ejects ink; however, a use of the liquid ejecting apparatus according to the present invention is not limited to printing.

Incidentally, in the technology in PTL 1, the front surface of the communication plate on which the nozzle plate is joined, is provided with the circulating communication channel. In such a configuration described above, it is actually difficult to efficiently circulate a liquid positioned in the vicinity of a nozzle to the circulation flow channel. With consideration for such circumstances described above, one of objects of a preferred aspect of the present invention is to efficiently circulate a liquid in the vicinity of a nozzle.

Aspect B1

In order to solve such a problem described above, according to still another preferred aspect (aspect B1) of the present invention, there is provided a liquid ejecting head including: a nozzle plate provided with a first nozzle and a second nozzle; a flow channel forming unit provided with a first pressure chamber and a second pressure chamber to which a liquid is supplied, a first communication channel through which the first nozzle and the first pressure chamber communicate with each other, a second communication channel through which the second nozzle and the second pressure chamber communicate with each other, and a circulating liquid chamber that is positioned between the first communication channel and the second communication channel; and a pressure generating unit that generates a pressure change in each of the first pressure chamber and the second pressure chamber. The nozzle plate is provided with a first circulation channel, through which the first communication channel and the circulating liquid chamber communicate with each other, and a second circulation channel, through which the second communication channel and the circulating liquid chamber communicate with each other. According to the aspect described above, since the first circulation channel, through which the first communication channel and the circulating liquid chamber communicate with each other, is formed in the nozzle plate, it is possible to more efficiently supply a liquid in the vicinity of a nozzle to the circulating liquid chamber than in a configuration of PTL 1 in which the circulating communication channel is formed in the communication plate. In addition, since the first circulation channel and the second circulation channel commonly communicate with the circulating liquid chamber positioned between the first communication channel and the second communication channel, an advantage is achieved in that a configuration of the liquid ejecting head is more simplified than in a configuration in which a circulating liquid chamber communicating with the first circulation channel is separately provided from a circulating liquid chamber communicating with the second circulation channel. In the following description, an amount of a liquid flowing into the circulating liquid chamber via the first circulation channel of the liquid circulating in the first communication channel is referred to as a "circulation amount", and an amount of a liquid that is ejected via the first nozzle of the liquid circulating in the first communication channel is referred to an "ejection amount".

Aspect B2

In a preferred example (aspect B2) according to the aspect B1, the first nozzle may be provided with a first zone and a second zone that has a diameter larger than that of the first zone and that is positioned on a side of the flow channel forming unit when viewed from the first zone. In the aspect described above, since the first nozzle is provided with the first zone and the second zone which have different inner diameters from each other, an advantage is achieved in that it is easy to set flow channel resistance of the first nozzle to a desired characteristic.

Aspect B3

In a preferred example (aspect B3) according to the aspect B2, the first circulation channel may have the same depth as a depth of the second zone. In the aspect described above, since the first circulation channel has the same depth as the depth of the second zone of the first nozzle, an advantage is achieved in that it is easier to form the first circulation channel and the second zone than in a configuration in which the first circulation channel and the second zone have different depths from each other.

Aspect B4

In a preferred example (aspect B4) according to the aspect B2, the first circulation channel may be deeper than the second zone. In the aspect described above, since the first circulation channel is deeper than the second zone of the first nozzle, the flow channel resistance of the first circulation channel is lower than that in a configuration in which the first circulation channel is shallower than the second zone. Hence, it is possible to more increase the circulation amount than in the configuration in which the first circulation channel is shallower than the second zone.

Aspect B5

In a preferred example (aspect B5) according to the aspect B2, the first circulation channel may be shallower than the second zone. In the aspect described above, since the first circulation channel is shallower than the second zone of the first nozzle, the flow channel resistance of the first circulation channel is higher than that in a configuration in which the first circulation channel is deeper than the second zone. Hence, it is possible to more increase the ejection amount than in the configuration in which the first circulation channel is deeper than the second zone.

Aspect B6

In a preferred example (aspect B6) according to any one of the aspects B2 to B5, the second zone may be continuous to the first circulation channel. In the aspect described above, the second zone of the first nozzle is continuous to the first circulation channel. Hence, the effect described above is remarkably achieved in that it is possible to efficiently circulate the liquid in the vicinity of the nozzle to the circulating liquid chamber.

Aspect B7

In a preferred example (aspect B7) according to any one of the aspects B1 to B5, the first nozzle and the first circulation channel may be separated from each other in a plane of the nozzle plate. In the aspect described above, the first nozzle and the first circulation channel are separated from each other. Hence, an advantage is achieved in that ensuring of the circulation amount is easily compatible with ensuring of the ejection amount.

Aspect B8

In a preferred example (aspect B8) according to the aspect B7, a flow channel length La of a portion of the first circulation channel, which overlaps the circulating liquid chamber, and a flow channel length Lb of a portion of the first circulation channel, which overlaps the first communication channel, may satisfy La>Lb. According to the aspect described above, an advantage is achieved in that it is easy to supply the liquid in the first communication channel to the circulating liquid chamber via the first circulation channel.

Aspect B9

In a preferred example (aspect B9) according to the aspect B8, a flow channel length Lc of a portion of the first circulation channel, which overlaps a partition wall between the first communication channel and the circulating liquid chamber in the flow channel forming unit may satisfy La>Lb>Lc. According to the aspect described above, an advantage is achieved in that it is easy to supply the liquid in the first communication channel to the circulating liquid chamber via the first circulation channel.

Aspect B10

In a preferred example (aspect B10) according to the aspect B6 or B7, a flow channel length La of a portion of the first circulation channel, which overlaps the circulating liquid chamber, and a flow channel length Lc of a portion of the first circulation channel, which overlaps a partition wall between the first communication channel and the circulating liquid chamber in the flow channel forming unit, may satisfy La>Lc. According to the aspect described above, an advantage is achieved in that it is easy to supply the liquid in the first communication channel to the circulating liquid chamber via the first circulation channel.

Aspect B11

In a preferred example (aspect B11) according to any one of the aspects B1 to B10, a flow channel width of the first circulation channel may be smaller than a maximum diameter of the first nozzle. In the aspect described above, since the flow channel width of the first circulation channel is smaller than the maximum diameter of the first nozzle, the flow channel resistance of the first circulation channel is higher than that in a configuration in which the flow channel width of the first circulation channel is larger than the maximum diameter of the first nozzle. Hence, it is possible to increase the ejection amount.

Aspect B12

In a preferred example (aspect B12) according to any one of the aspects B1 to B11, the flow channel width of the first circulation channel may be smaller than a flow channel width of the first pressure chamber. In the aspect described above, since the flow channel width of the first circulation channel is smaller than the flow channel width of the first pressure chamber, the flow channel resistance of the first circulation channel is higher than that in a configuration in which the flow channel width of the first circulation channel is larger than the flow channel width of the first pressure chamber. Hence, it is possible to increase the ejection amount.

Aspect B13

In a preferred example (aspect B13) according to any one of the aspects B1 to B12, a flow channel width of a portion of the first circulation channel on a side of the circulating liquid chamber may be wider than a flow channel width of a portion thereof on a side of the first nozzle. In the aspect described above, since the flow channel width of the portion of the first circulation channel on the side of the circulating liquid chamber is wider than the flow channel width of the portion thereof on the side of the first nozzle, it is easy to supply the liquid in the first communication channel to the circulating liquid chamber via the first circulation channel. Hence, an advantage is achieved in that it is easy to ensure the circulation amount.

Aspect B14

In a preferred example (aspect B14) according to any one of the aspects B1 to B12, a flow channel width of an intermediate portion of the first circulation channel may be narrower than the flow channel width of the portion thereof on the side of the circulating liquid chamber and the flow channel width of the portion thereof on the side of the first nozzle when viewed from the intermediate portion. In the aspect described above, since the flow channel width of the intermediate portion of the first circulation channel is narrower than that of the portion thereof on the side of the circulating liquid chamber and that of the portion thereof on the side of the first nozzle, the flow channel resistance of the first circulation channel is higher than that in a configuration in which the flow channel width of the first circulation channel is constant. Hence, it is possible to increase the ejection amount.

Aspect B15

In a preferred example (aspect B15) according to any one of the aspects B1 to B12, a flow channel width of an intermediate portion of the first circulation channel may be wider than the flow channel width of the portion thereof on the side of the circulating liquid chamber and the flow channel width of the portion thereof on the side of the first nozzle when viewed from the intermediate portion. In the aspect described above, since the flow channel width of the intermediate portion of the first circulation channel is wider than that of the portion thereof on the side of the circulating liquid chamber and that of the portion thereof on the side of the first nozzle, the flow channel resistance of the first circulation channel is lower than that in a configuration in which the flow channel width of the first circulation channel is constant. Hence, it is possible to increase the circulation amount.

Aspect B16

In a preferred example (aspect B16) according to any one of the aspects B1 to B15, a center axis of the first nozzle may be positioned on an opposite side of the circulating liquid chamber when viewed from a center axis of the first communication channel. In the aspect described above, since the center axis of the first nozzle is positioned on the opposite side of the circulating liquid chamber when viewed from the center axis of the first communication channel, it is possible to more decrease the circulation amount and more increase the ejection amount than in a configuration in which the center axis of the first nozzle is positioned on the side of the circulating liquid chamber when viewed from the center axis of the first communication channel.

Aspect B17

In a preferred example (aspect B17) according to any one of the aspects B1 to B15, the center axis of the first nozzle may be positioned at the same location as the center axis of the first communication channel. In the aspect described above, as the center axis of the first nozzle and the center axis of the first communication channel are positioned at the same location, an advantage is achieved in that ensuring of the ejection amount is more easily compatible with ensuring of the circulation amount than in a configuration in which the center axis of the first nozzle and the center axis of the first communication channel are positioned at different locations from each other.

Aspect B18

In a preferred example (aspect B18) according to any one of the aspects B1 to B15, the center axis of the first nozzle may be positioned on the side of the circulating liquid chamber when viewed from the center axis of the first communication channel. In the aspect described above, since the center axis of the first nozzle is positioned on the side of the circulating liquid chamber when viewed from the center axis of the first communication channel, it is possible to more increase the circulation amount and more decrease the ejection amount than in a configuration in which the center axis of the first nozzle is positioned on the opposite side of the circulating liquid chamber when viewed from the center axis of the first communication channel.

Aspect B19

In a preferred example (aspect B19) according to any one of the aspects B1 to B18, the intermediate portion of the first circulation channel may be deeper than the portion thereof on the side of the circulating liquid chamber and the portion thereof on the side of the first nozzle when viewed from the intermediate portion. In the aspect described above, since the intermediate portion of the first circulation channel is deeper than the portion thereof on the side of the circulating liquid chamber and the portion thereof on the side of the first nozzle, the flow channel resistance of the first circulation channel is lower than that in a configuration in which the entire first circulation channel has a constant depth. Hence, it is possible to increase the circulation amount.

Aspect B20

In a preferred example (aspect B20) according to any one of the aspects B1 to B19, when a pressure change is generated in the first pressure chamber, an amount of the liquid that is supplied to the circulating liquid chamber via the first circulation channel may be larger than an amount of the liquid that is ejected from the first nozzle. In the aspect described above, the circulation amount is larger than the ejection amount. In other words, it is possible to effectively circulate the liquid in the vicinity of the nozzle to the circulating liquid chamber while the ejection amount is ensured.

Aspect B21

In a preferred example (aspect B21) according to any one of the aspects B1 to B20, the first circulation channel and the circulating liquid chamber may overlap each other, the first circulation channel and the first pressure chamber may overlap each other, and the circulating liquid chamber and the first pressure chamber may not overlap each other. In the aspect described above, the first circulation channel overlaps the circulating liquid chamber and the first pressure chamber, but the circulating liquid chamber and the first pressure chamber do not overlap each other. Hence, an advantage is achieved in that it is easier to decrease the liquid ejecting head in size than in a configuration in which the first circulation channel and the first pressure chamber do not overlap each other, for example.

Aspect B22

In a preferred example (aspect B22) according to any one of the aspects B1 to B20, the first circulation channel and the circulating liquid chamber may overlap each other, the first circulation channel and the pressure generating unit may overlap each other, and the circulating liquid chamber and the pressure generating unit may not overlap each other. In the aspect described above, the first circulation channel overlaps the circulating liquid chamber and the pressure generating unit, but the circulating liquid chamber and the pressure generating unit do not overlap each other. Hence, an advantage is achieved in that it is easier to decrease the liquid ejecting head in size than in a configuration in which the first circulation channel and the pressure generating unit do not overlap each other, for example.

Aspect B23

In a preferred example (aspect B23) according to any one of the aspects B1 to B20, an end surface of the first pressure chamber on a side of the first communication channel may be an inclined surface inclined with respect to an upper surface of the first pressure chamber, and the first circulation channel and the upper surface of the first pressure chamber may not overlap each other.

Aspect B24

In a preferred example (aspect B24) according to any one of the aspects B1 to B23, the first pressure chamber and the circulating liquid chamber may communicate with each other via the first communication channel and the first circulation channel. In the aspect described above, the first pressure chamber and the circulating liquid chamber communicate with each other in a joint manner via the first communication channel and the first circulation channel. Hence, it is possible to supply the liquid to the circulating liquid chamber while the ejection amount is more appropriately ensured than in a configuration in which the first pressure chamber and the circulating liquid chamber directly communicate with each other.

Aspect B25

In a preferred example (aspect B25) according to any one of the aspects B1 to B24, each of the nozzle plate and the flow channel forming unit may include a substrate formed by silicon. In the aspect described above, since each of the nozzle plate and the flow channel forming unit includes the silicon substrate, an advantage is achieved in that it is possible to form a flow channel in the nozzle plate and the flow channel forming unit with high accuracy by using a semiconductor manufacturing technology, for example.

Aspect B26

According to still another preferred aspect of the present invention, there is provided a liquid ejecting apparatus including the liquid ejecting head according to any one of the aspects exemplified above. A preferable example of the liquid ejecting apparatus is a printing apparatus that ejects ink; however, a use of the liquid ejecting apparatus according to the present invention is not limited to printing.

DESCRIPTION OF EMBODIMENTS

First Embodiment

Figure 1:
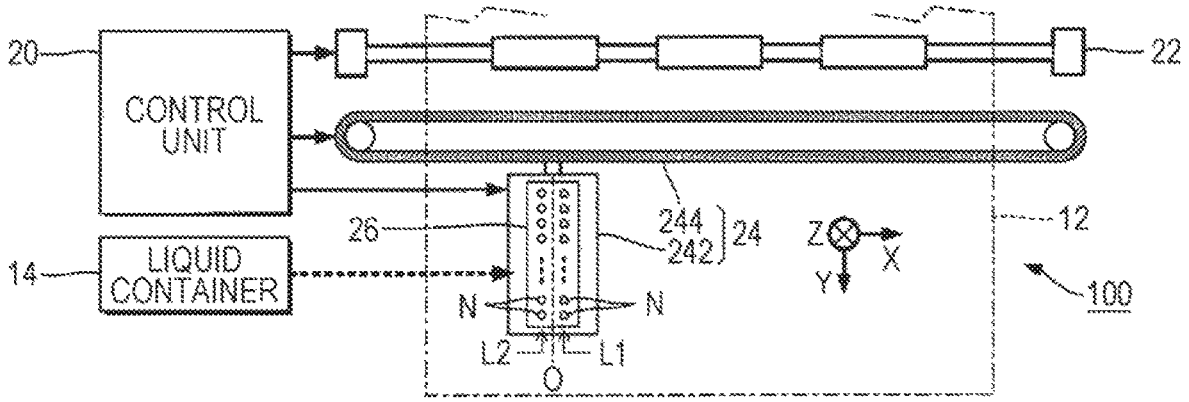
FIG. 1 is a diagram of a configuration of a liquid ejecting apparatus according to a first embodiment of the present invention.

FIG. 1 is a diagram of a configuration exemplifying a liquid ejecting apparatus 100 according to a first embodiment of the present invention. The liquid ejecting apparatus 100 of the first embodiment is an ink jet type printing apparatus that ejects ink as an example of a liquid to a medium 12. The medium 12 is a common printing sheet, and any printing target made of any material such as a resin film or cloth can be used as the medium 12. As illustrated in FIG. 1, a liquid container 14 that stores inks is disposed in the liquid ejecting apparatus 100. For example, a cartridge, a pouch-shaped ink bag formed by a flexible film, or a refillable ink tank, which is attachable to and detachable from the liquid ejecting apparatus 100, is used as the liquid container 14. A plurality of types of different color inks are stored in the liquid container 14.

As illustrated in FIG. 1, the liquid ejecting apparatus 100 includes a control unit 20, a transport mechanism 22, a moving mechanism 24, and a liquid ejecting head 26. For example, the control unit 20 includes a processing circuit such as a central processing unit (CPU) or a field programmable gate array (FPGA) and a memory circuit such as a semiconductor memory and collectively controls elements of the liquid ejecting apparatus 100. The transport mechanism 22 transports the medium 12 in a Y direction under control by the control unit 20.

The moving mechanism 24 causes the liquid ejecting head 26 to reciprocate in an X direction under the control by the control unit 20. The X direction is a direction intersecting with (typically, orthogonal to) the Y direction in which the medium 12 is transported. The moving mechanism 24 of the first embodiment has a substantially box-shaped transport member 242 (carriage), which accommodates the liquid ejecting head 26, and a transport belt 244 to which the transport member 242 is fixed. It is possible to employ a configuration in which a plurality of liquid ejecting heads 26 are mounted on the transport member 242 or a configuration in which the liquid container 14 and the liquid ejecting head 26 are both mounted on the transport member 242.

The liquid ejecting head 26 eject ink, which is supplied from the liquid container 14, to the medium 12 from a plurality of nozzles N (ejecting holes) under the control by the control unit 20. The liquid ejecting head 26 ejects the inks to the medium 12 in parallel with transport of the medium 12 by the transport mechanism 22 and repeated reciprocating of the transport member 242, and thereby a desired image is formed on a front surface of the medium 12. Hereinafter, a direction perpendicular to an X-Y plane (for example, a plane parallel to the front surface of the medium 12) is referred to as a Z direction. A direction (typically, vertical direction) of ejecting ink by the liquid ejecting head 26 corresponds to the Z direction.

As illustrated in FIG. 1, the plurality of nozzles N of the liquid ejecting head 26 are arranged in the Y direction. The plurality of nozzles N of the first embodiment is divided into a first array L1 and a second array L2 which are provided side by side with a gap between the rows in the X direction. The first array L1 and the second array L2 are each a set of the plurality of nozzles N arranged linearly in the Y direction. Positions of the nozzles N in the Y direction can be different between the first array L1 and the second array L2 (that is, a zigzag arrangement or a staggered arrangement). However, a configuration in which the positions of the nozzles N in the Y direction are coincident with each other in the first array L1 and the second array L2 will be described for descriptive purposes, hereinafter. A plane (Y-Z plane) O that passes through a center axis parallel to the Y direction and that is parallel to the Z direction in the liquid ejecting head 26 is referred to as a "center plane" in the following description.

Figure 2:
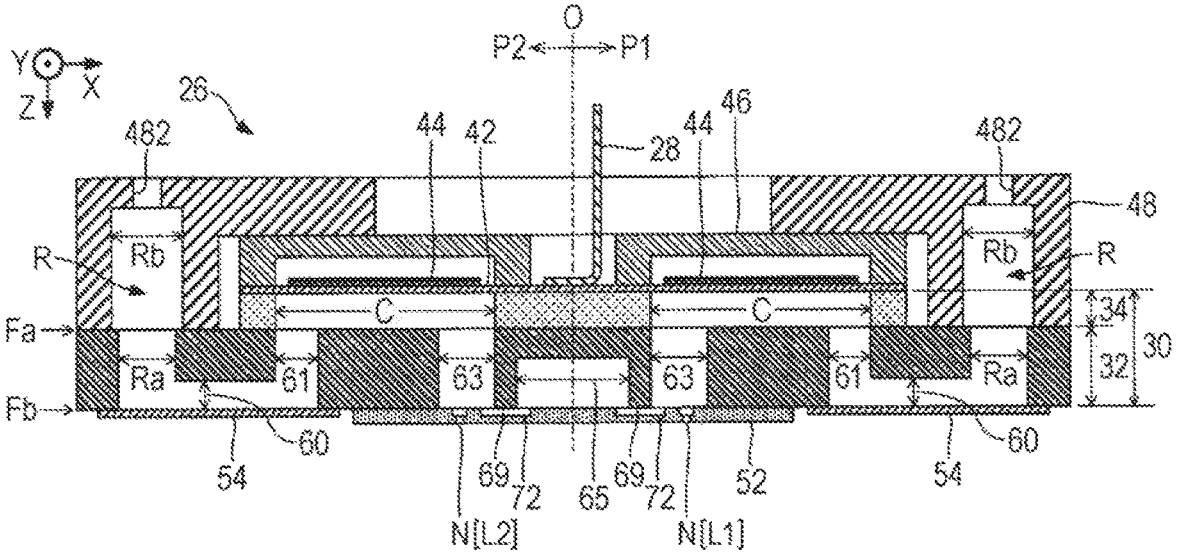
FIG. 2 is a sectional view of a liquid ejecting head.
Figure 3:
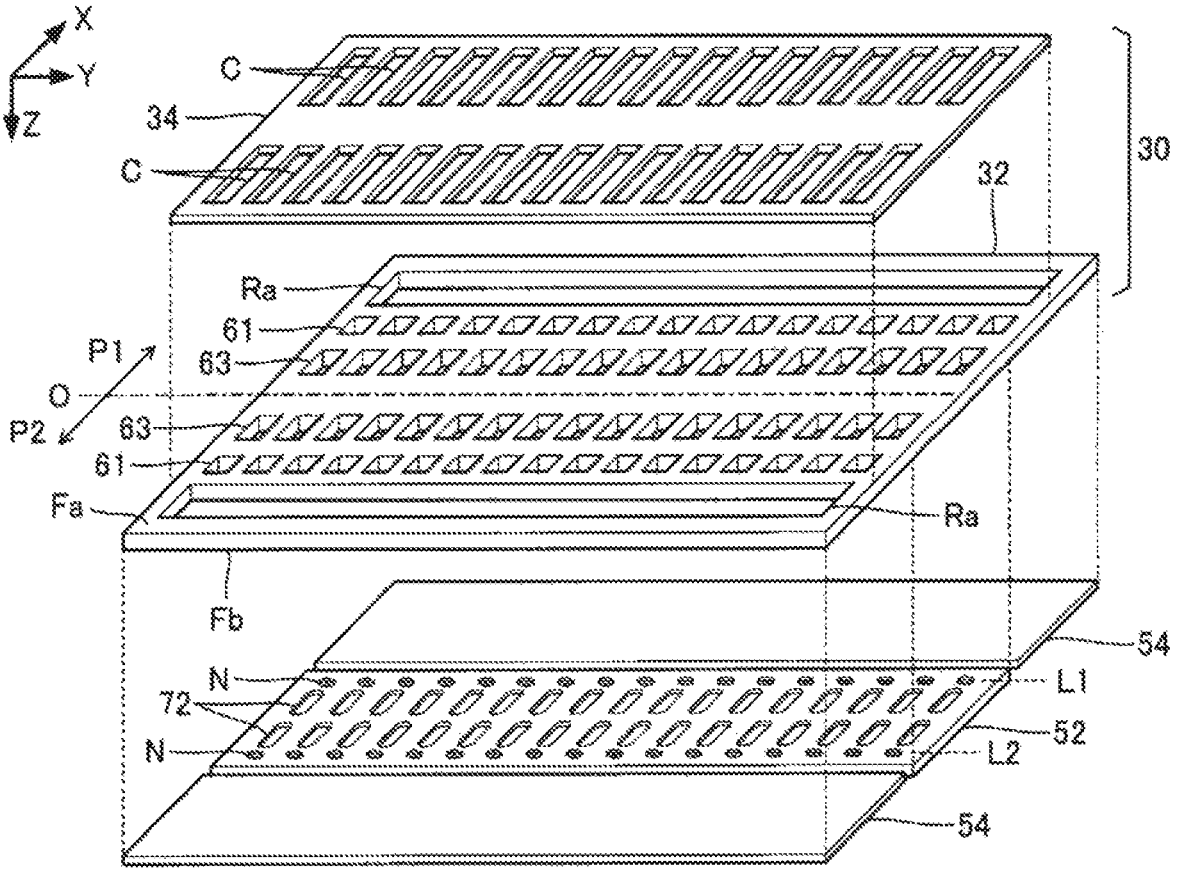
FIG. 3 is a partially exploded perspective view of the liquid ejecting head.

FIG. 2 is a sectional view of the liquid ejecting head 26 on a section perpendicular to the Y direction, and FIG. 3 is a partially exploded perspective view of the liquid ejecting head 26. As understood from FIGS. 2 and 3, the liquid ejecting head 26 of the first embodiment has a structure in which an element related to the nozzles N of the first array L1 (exemplifying a first nozzle) and an element related to the nozzles N of the second array L2 (exemplifying a second nozzle) are disposed in plane symmetry with the center plane O interposed therebetween. In other words, a structure of a portion (hereinafter, referred to as a "first portion") P1 on a positive side in the X direction and a portion (hereinafter, referred to as a "second portion") P2 on a negative side in the X direction with the center plane O interposed the portions of the liquid ejecting head 26 is practically common. The plurality of nozzles N in the first array L1 are formed in the first portion P1, and the plurality of nozzles N in the second array L2 are formed in the second portion P2. The center plane O corresponds to a boundary plane between the first portion P1 and the second portion P2.

As illustrated in FIGS. 2 and 3, the liquid ejecting head 26 includes a flow channel forming unit 30. The flow channel forming unit 30 is a structure provided with flow channels for supplying ink to the plurality of nozzles N. The flow channel forming unit 30 of the first embodiment has a configuration in which a first flow channel substrate 32 (communication plate) and a second flow channel substrate 34 (pressure chamber forming plate) are stacked. Each of the first flow channel substrate 32 and the second flow channel substrate 34 is a plate-like member elongated in the Y direction. The second flow channel substrate 34 is disposed on a front surface Fa of the first flow channel substrate 32 on a negative side in the Z direction, by using an adhesive, for example.

As illustrated in FIG. 2, on the front surface Fa of the first flow channel substrate 32, a vibrating unit 42, a plurality of piezoelectric elements 44, a protective member 46, and a housing 48 are disposed, in addition to the second flow channel substrate 34, (not illustrated in FIG. 3). On the other hand, a nozzle plate 52 and a vibration absorber 54 are disposed on a front surface Fb of the first flow channel substrate 32 on a positive side (that is, an opposite side of the front surface Fa) in the Z direction. Elements of the liquid ejecting head 26 are schematically plate-like members elongated in the Y direction similarly to the first flow channel substrate 32 and the second flow channel substrate 34 and are joined to each other by using an adhesive, for example. It is possible to determine, as the Z direction, a direction in which the first flow channel substrate 32 and the second flow channel substrate 34 are stacked and a direction (or a direction perpendicular to front surfaces of plate-like elements) in which the first flow channel substrate 32 and the nozzle plate 52 are stacked.

The nozzle plate 52 is a plate-like member provided with the plurality of nozzles N and is disposed on the front surface Fb of the first flow channel substrate 32 by using an adhesive, for example. Each of the plurality of nozzles N is a circular through-hole through which the ink passes. The nozzle plate 52 of the first embodiment is provided with the plurality of nozzles N that configure the first array L1 and the plurality of nozzles N that configure the second array L2. Specifically, when viewed from the center plane O, the plurality of nozzles N of the first array L1 are formed along the Y direction in a region of the nozzle plate 52 on the positive side of the X direction, and the plurality of nozzles N of the second array L2 are formed along the Y direction in a region thereof on the negative side in the X direction. The nozzle plate 52 of the first embodiment is a single plate-like member in which a portion provided with the plurality of nozzles N of the first array L1 and a portion provided with the plurality of nozzles N of the second array L2 are continuous to each other. The nozzle plate 52 of the first embodiment is manufactured by processing a silicon (Si) monocrystalline substrate by using a semiconductor manufacturing technology (for example, a processing technology such as dry etching or wet etching). However, it is possible to optionally employ a known material or manufacturing method for manufacturing the nozzle plate 52.

As illustrated in FIGS. 2 and 3, the first flow channel substrate 32 is provided with a space Ra, a liquid supply chamber 60, a plurality of supply channels 61, and a plurality of communication channels 63 in each of the first portion P1 and the second portion P2. The space Ra is an opening formed into an elongated shape along the Y direction in a plan view (that is, viewed from the Z direction), and the supply channel 61 and the communication channel 63 are through-holes formed for each nozzle N. The liquid supply chamber 60 is a space formed into an elongated shape along the Y direction over the plurality of nozzles N, and the space Ra and the plurality of supply channels 61 communicate with each other through the liquid supply chamber. The plurality of communication channels 63 are arranged in the Y direction in a plan view, and the plurality of supply channels 61 are arranged in the Y direction between the arrangement of the plurality of communication channels 63 and the space Ra. The plurality of supply channels 61 commonly communicate with the space Ra. In addition, any one communication channel 63 overlaps a nozzle N corresponding to the communication channel 63 in a plan view. Specifically, any one communication channel 63 of the first portion P1 communicates with one nozzle N of the first array L1, the nozzle corresponding to the communication channel 63. Similarly, any one communication channel 63 of the second portion P2 communicates with one nozzle N of the second array L2, the nozzle corresponding to the communication channel 63.

As illustrated in FIGS. 2 and 3, the second flow channel substrate 34 is a plate-like member provided with a plurality of pressure chambers C in each of the first portion P1 and the second portion P2. The plurality of pressure chambers C are arranged in the Y direction. The pressure chamber C (cavity) is a space that is formed for each nozzle N and that has an elongated shape along the X direction in a plan view. Similarly to the nozzle plate 52 described above, the first flow channel substrate 32 and the second flow channel substrate 34 are manufactured by processing a silicon monocrystalline substrate by using a semiconductor manufacturing technology, for example. However, it is possible to optionally employ a known material or manufacturing method for manufacturing the first flow channel substrate 32 and the second flow channel substrate 34. As described above, in the first embodiment, the flow channel forming unit 30 (the first flow channel substrate 32 and the second flow channel substrate 34) and the nozzle plate 52 contain a substrate formed by silicon. Hence, the semiconductor manufacturing technology is used as described above, and thereby an advantage is achieved in that it is possible to form a fine flow channel in the flow channel forming unit 30 and the nozzle plate 52 with high accuracy.

As illustrated in FIG. 2, the vibrating unit 42 is disposed on a front surface of the second flow channel substrate 34 on an opposite side of the first flow channel substrate 32. The vibrating unit 42 of the first embodiment is a plate-like member (vibrating plate) that can elastically vibrate. A part of region of the plate-like member having a predetermined thickness in a plate thickness direction is selectively removed, the region corresponding to the pressure chamber C, and thereby it is possible to integrally form the second flow channel substrate 34 and the vibrating unit 42.

As understood from FIG. 2, the front surface Fa of the first flow channel substrate 32 and the vibrating unit 42 are opposite to each other with a gap therebetween on an inner side of each pressure chamber C. The pressure chamber C is a space positioned between the front surface Fa of the first flow channel substrate 32 and the vibrating unit 42 and generates a pressure change in ink with which the space is filled. Each of the pressure chambers C is a space having a longitudinal direction in the X direction and is individually formed for each nozzle N. A plurality of pressure chambers C are arranged in the Y direction for each of the first array L1 and the second array L2. As illustrated in FIGS. 2 and 3, an end portion of any one pressure chamber C on a side of the center plane O overlaps the communication channel 63 in a plan view, and an end portion thereof on the opposite side of the center plane O overlaps the supply channel 61 in a plan view. Hence, the pressure chambers C communicate with the nozzles N via the communication channels 63 in each of the first portion P1 and the second portion P2 and communicate with the space Ra via the supply channels 61. The pressure chamber C is provided with a narrowed flow channel having a constricted flow channel width, and thereby it is possible to apply predetermined flow channel resistance.

Figure 4:
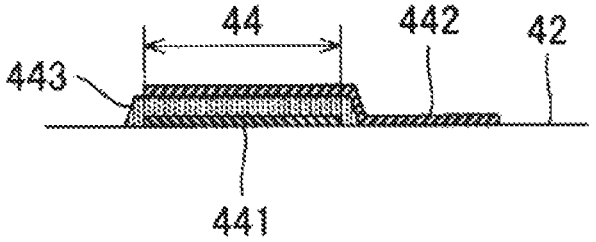
FIG. 4 is a sectional view of a piezoelectric element.

As illustrated in FIG. 2, the plurality of piezoelectric elements 44 corresponding to different nozzles N from each other are disposed on a surface of the vibrating unit 42 on an opposite side of the pressure chambers C, in each of the first portion P1 and the second portion P2. The piezoelectric element 44 is a passive element that changes due to a supply of a drive signal. The plurality of piezoelectric elements 44 are arranged in the Y direction so as to correspond to the pressure chambers C. As illustrated in FIG. 4, any one piezoelectric element 44 is a stacked body in which a piezoelectric layer 443 is sandwiched between a first electrode 441 and a second electrode 442 which are opposite to each other. One of the first electrode 441 and the second electrode 442 can be an electrode (that is, common electrode) that is continuous over the plurality of piezoelectric elements 44. A portion in which the first electrode 441, the second electrode 442, and the piezoelectric layer 443 overlap each other functions as the piezoelectric element 44. A portion (that is, an active portion that vibrates the vibrating unit 42) that changes due to the supply of the drive signal can be demarcated as the piezoelectric element 44. As understood from the description provided above, the liquid ejecting head 26 of the first embodiment includes a first piezoelectric element and a second piezoelectric element. For example, the first piezoelectric element is the piezoelectric element 44 on one side (for example, the right side in FIG. 2) in the X direction when viewed from the center plane O, and the second piezoelectric element is the piezoelectric element 44 on the other side (for example, the left side in FIG. 2) in the X direction when viewed from the center plane O. When the vibrating unit 42 vibrates along with deformation of the piezoelectric element 44, a pressure in the pressure chamber C changes, and thereby ink, with which the pressure chamber C is filled, passes through the communication channel 63 and the nozzle N and is ejected.

The protective member 46 of FIG. 2 is a plate-like member for protecting the plurality of piezoelectric elements 44 and is disposed on a front surface of the vibrating unit 42 (or a front surface of the second flow channel substrate 34). Any material or any manufacturing method of the protective member 46 can be employed; however, similarly to the first flow channel substrate 32 and the second flow channel substrate 34, the protective member 46 can be formed by processing a silicon (Si) monocrystalline substrate by using a semiconductor manufacturing technology, for example. The plurality of piezoelectric elements 44 are accommodated in a recessed portion formed on a front surface of the protective member 46 on a side of the vibrating unit 42.

An end portion of a wiring substrate 28 is joined to the front surface of the vibrating unit 42 (front surface of the flow channel forming unit 30) on the opposite side of the flow channel forming unit 30. In other words, the end portion of the wiring substrate 28 is joined to the front surface on the opposite side of the nozzle plate 52 with the flow channel forming unit 30 interposed therebetween. The wiring substrate 28 is a flexible mounting component provided with a plurality of wires (not shown) that electrically couples the control unit 20 to the liquid ejecting head 26. An end portion of the wiring substrate 28, which passes through an opening portion formed in the protective member 46 and an opening portion formed in the housing 48 and extends outside, is coupled to the control unit 20. For example, the flexible wiring substrate 28 such as a flexible printed circuit (FPC) or a flexible flat cable (FFC) is preferably employed.

The housing 48 is a case for storing ink that is supplied to the plurality of pressure chambers C (further to the plurality of nozzles N). For example, a front surface of the housing 48 on the positive side in the Z direction is joined to the front surface Fa of the first flow channel substrate 32 with an adhesive. It is possible to optionally employ a known material or manufacturing method for manufacturing the housing 48. For example, it is possible to form the housing 48 by injection molding of a resin material.

As illustrated in FIG. 2, the housing 48 of the first embodiment is provided with a space Rb in each of the first portion P1 and the second portion P2. The zone Rb of the housing 48 and the space Ra of the first flow channel substrate 32 communicate with each other. A space configured of the space Ra and the space Rb functions as a liquid reservoir (reservoir) R that stores ink that is supplied to the plurality of pressure chambers C. The liquid reservoir R is a common liquid chamber that is common to the plurality of nozzles N. The liquid reservoir R is formed in each of the first portion P1 and the second portion P2. The liquid reservoir R of the first portion P1 is positioned on the positive side in the X direction when viewed from the center plane O, and the liquid reservoir R of the second portion P2 is positioned on the negative side in the X direction when viewed from the center plane O. A front surface of the housing 48 on the opposite side of the first flow channel substrate 32 is provided with an introduction port 482 for introducing ink, which is supplied from the liquid container 14, to the liquid reservoir R. The liquid in the liquid reservoir R is supplied to the pressure chamber C via the liquid supply chamber 60 and the supply channels 61.

As illustrated in FIG. 2, the vibration absorber 54 is disposed on the front surface Fb of the first flow channel substrate 32 in each of the first portion P1 and the second portion P2. The vibration absorber 54 is a flexible film (compliance substrate) that absorbs a pressure change of ink in the liquid reservoir R. As illustrated in FIG. 3, the vibration absorber 54 is disposed on the front surface Fb of the first flow channel substrate 32 so as to block the space Ra and the plurality of supply channels 61 of the first flow channel substrate 32 and configures a wall surface (specifically, a bottom surface) of the liquid reservoir R.

As illustrated in FIG. 2, a space (hereinafter, referred to as a "circulating liquid chamber") 65 is formed on the front surface Fb of the first flow channel substrate 32, which is opposite to the nozzle plate 52. The circulating liquid chamber 65 of the first liquid is a bottomed hole (groove) having an elongated shape extending in the Y direction in a plan view. The nozzle plate 52 joined to the front surface Fb of the first flow channel substrate 32 blocks an opening of the circulating liquid chamber 65.

Figure 5:
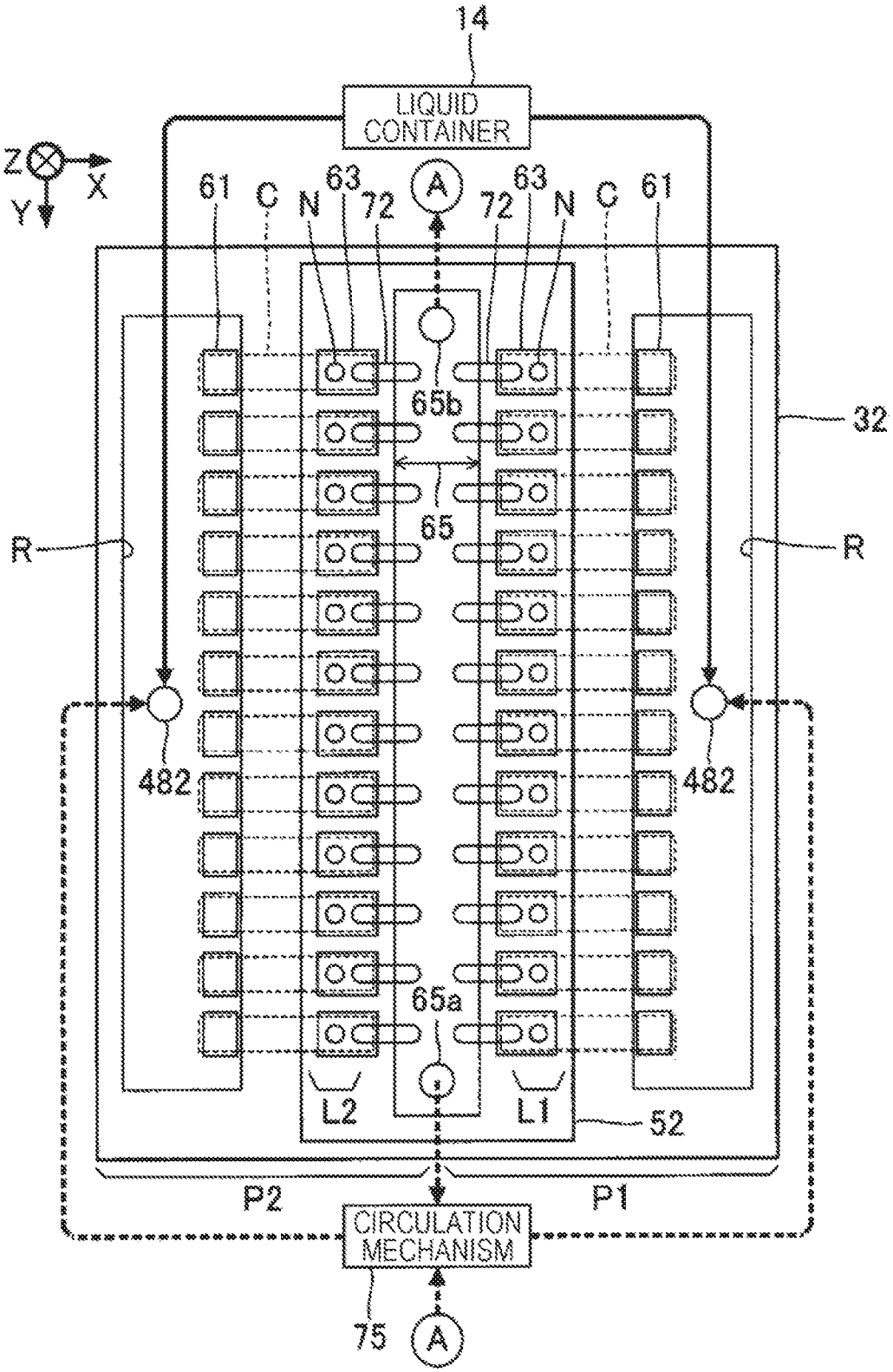
FIG. 5 is a diagram showing circulation of ink in the liquid ejecting head.

FIG. 5 is a diagram showing a configuration of the liquid ejecting head 26 by focusing on the circulating liquid chamber 65. As illustrated in FIG. 5, the circulating liquid chamber 65 is continuous over the plurality of nozzles N along the first array L1 and the second array L2. Specifically, the circulating liquid chamber 65 is positioned between the arrangement of the plurality of nozzles N of the first array L1 and the arrangement of the plurality of nozzles N of the second array L2. Hence, as illustrated in FIG. 2, the circulating liquid chamber 65 is positioned between the communication channels 63 in the first portion P1 and the communication channels 63 in the second portion P2. As understood from the description provided above, the flow channel forming unit 30 of the first embodiment is a structure provided with the pressure chambers C (first pressure chambers) and the communication channels 63 (first communication channels) in the first portion P1, the pressure chambers C (second pressure chambers) and the communication channels 63 (second communication channels) in the second portion P2, and the circulating liquid chamber 65 positioned between the communication channels 63 in the first portion P1 and the communication channels 63 in the second portion P2. As illustrated in FIG. 2, the flow channel forming unit 30 of the first embodiment includes a partition wall-shaped portion (hereinafter, referred to as a "partition wall") 69 between the circulating liquid chamber 65 and the communication channels 63. As understood from FIG. 2, the circulating liquid chamber 65 overlaps the end portion of the wiring substrate 28 in a plan view.

As described above, the plurality of pressure chambers C and the plurality of piezoelectric elements 44 are arranged in the Y direction in each of the first portion P1 and the second portion P2. This can also be described as follows. The circulating liquid chamber 65 extends in the Y direction to be continuous over the plurality of pressure chambers C or the plurality of piezoelectric elements 44 in each of the first portion P1 and the second portion P2. In addition, as understood from FIGS. 2 and 3, the circulating liquid chamber 65 and the liquid reservoir R extend in the Y direction with a gap therebetween, and the pressure chambers C, the communication channels 63, and the nozzles N can be positioned in the gap.

Figure 6:
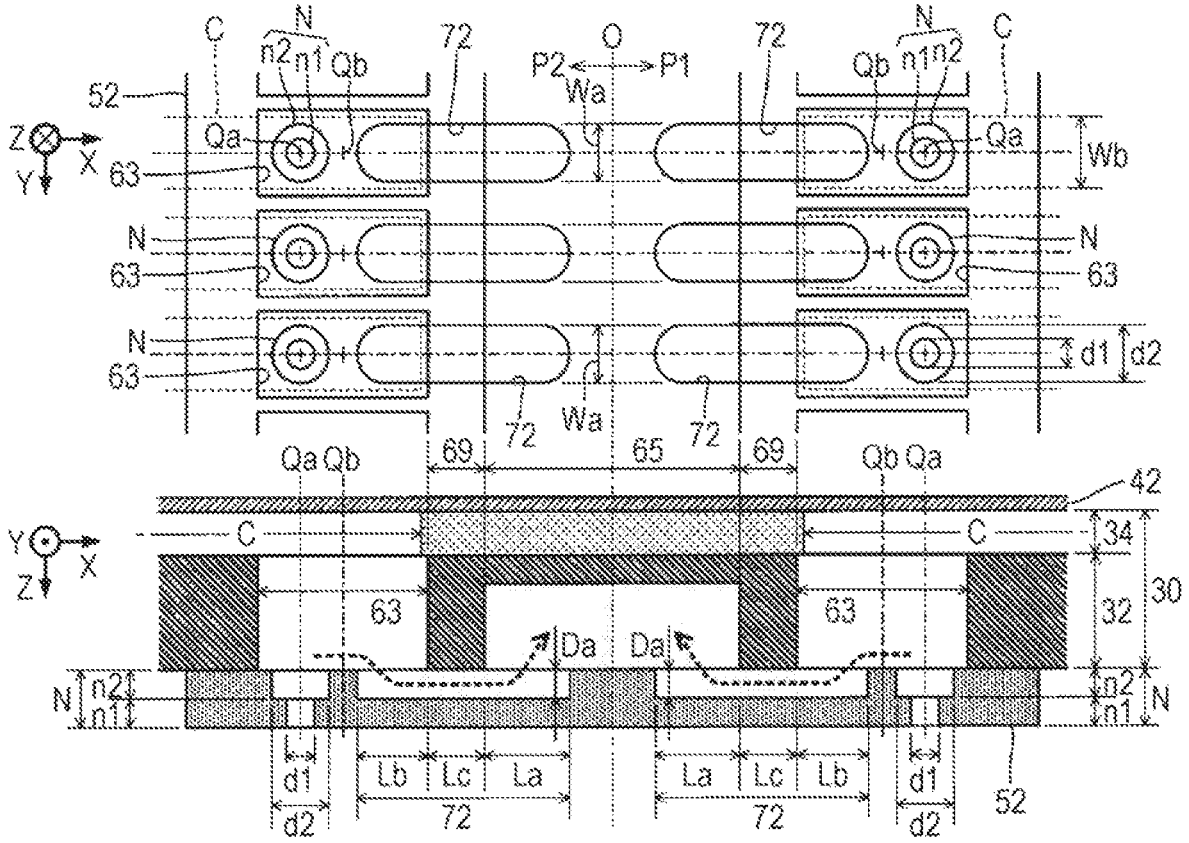
FIG. 6 shows a plan view and a sectional view in the vicinity of a circulating liquid chamber of the liquid ejecting head.

FIG. 6 shows an enlarged plan view and an enlarged sectional view of a portion in the vicinity of the circulating liquid chamber 65 of the liquid ejecting head 26. As illustrated in FIG. 6, one nozzle N according to the first embodiment contains a first zone n1 and a second zone n2. The first zone n1 and the second zone n2 are coaxially formed to be circular spaces that communicate with each other. The second zone n2 is positioned on a side of the flow channel forming unit 30 viewed from the first zone n1. An inner diameter d2 of the second zone n2 is larger than an inner diameter d1 of the first zone n1 (d2>d1). As described above, according to a configuration in which the nozzles N are formed in a step shape, an advantage is achieved in that it is easy to set flow channel resistance of the nozzles N to a desired characteristic. In addition, as illustrated in FIG. 6, a center axis Qa of the nozzles N according to the first embodiment is positioned on an opposite side of the circulating liquid chamber 65 when viewed from a center axis Qb of the communication channels 63.

As illustrated in FIG. 6, a plurality of circulation channels 72 in each of the first portion P1 and the second portion P2 are formed on a front surface of the nozzle plate 52, which is opposite to the flow channel forming unit 30. A plurality of circulation channels 72 (exemplifying first circulation channels) of the first portion P1 correspond to the plurality of nozzles N of the first array L1 (or the plurality of communication channels 63 corresponding to the first array L1), respectively. In addition, a plurality of circulation channels 72 (exemplifying second circulation channels) of the second portion P2 correspond to the plurality of nozzles N of the second array L2 (or the plurality of communication channels 63 corresponding to the second array L2), respectively.

Each of the circulation channels 72 is a groove (that is, a bottomed hole having an elongated shape) extending in the X direction and functions as a flow channel through which the ink is circulated. The circulation channel 72 of the first embodiment is formed at a position separated from the nozzle N (specifically, on a side of the circulating liquid chamber 65 when viewed from the nozzle N corresponding to the circulation channel 72). For example, the plurality of nozzles N (particularly, the second zone n2) and the plurality of circulation channels 72 are collectively formed in a common process by the semiconductor manufacturing technology (for example, a processing technology such as dry etching or wet etching).

As illustrated in FIG. 6, each of the circulation channels 72 is formed into a linear shape having a flow channel width Wa that is equal to the inner diameter d2 of the second zone n2 of the nozzle N. In addition, the flow channel width (dimension in the Y direction) Wa of the circulation channel 72 according to the first embodiment is narrower than a flow channel width (dimension in the Y direction) Wb of the pressure chamber C. Hence, it is possible to more increase the flow channel resistance of the circulation channel 72 than in a configuration in which the flow channel width Wa of the circulation channel 72 is wider than the flow channel width Wb of the pressure chamber C. On the other hand, a depth Da of the circulation channel 72 with respect to the surface of the nozzle plate 52 is constant over the entire length thereof. Specifically, the circulation channels 72 are formed at the same depth as that of the second zones n2 of the nozzles N. According to the configuration described above, an advantage is achieved in that it is easier to form the circulation channel 72 and the second zone n2 than in a configuration in which the circulation channel 72 and the second zone n2 are formed to have different depths from each other. The "depth" of the flow channel means a depth of the flow channel in the Z direction (for example, a difference in height between a flow channel formed surface and a bottom surface of the flow channel).

Any one circulation channel 72 in the first portion P1 is positioned on the side of the circulating liquid chamber 65 when viewed from the nozzle N of the first array L1, the nozzle corresponding to the circulation channel 72. In addition, any one circulation channel 72 in the second portion P2 is positioned on the side of the circulating liquid chamber 65 when viewed from the nozzle N of the second array L2, the nozzle corresponding to the circulation channel 72. An end portion of the circulation channel 72 on the opposite side (side of the communication channel 63) of the center plane O overlaps one communication channel 63 corresponding to the circulation channel 72 in a plan view. In other words, the circulation channel 72 communicates with the communication channel 63. On the other hand, an end portion of the circulation channel 72 on the side (side of the circulating liquid chamber 65) of the center plane O overlaps the circulating liquid chamber 65 in a plan view. In other words, the circulation channel 72 communicates with the circulating liquid chamber 65. As understood from the description provided above, each of the plurality of communication channels 63 communicates with the circulating liquid chamber 65 via the circulation channel 72. Hence, as illustrated by a dashed-line arrow in FIG. 6, the ink in the communication channels 63 is supplied to the circulating liquid chamber 65 via the circulation channels 72. In other words, in the first embodiment, the plurality of communication channels 63 corresponding to the first array L1 and the plurality of communication channels 63 corresponding to the second array L2 commonly communicate with the one circulating liquid chamber 65.

FIG. 6 illustrates a flow channel length La of a portion of any one circulation channel 72 that overlaps the circulating liquid chamber 65, a flow channel length (dimension in the X direction) Lb of a portion of the circulation channel 72 that overlaps the communication channel 63, and a flow channel length (dimension in the X direction) Lc of a portion of the circulation channel 72 that overlaps the partition wall 69 of the flow channel forming unit 30. The flow channel length Lc corresponds to a thickness of the partition wall 69. The partition wall 69 functions as a narrowed portion of the circulation channel 72. Hence, the longer the flow channel length Lc corresponding to the thickness of the partition wall 69 is, the more the flow channel resistance of the circulation channel 72 increases. In the first embodiment, a relationship that the flow channel length La is longer than the flow channel length Lb (La>Lb), and the flow channel length La is longer than the flow channel length Lc (La>Lc) is established. Further, in the first embodiment, a relationship that the flow channel length Lb is longer the flow channel length Lc (Lb>Lc) is established (La>Lb>Lc). According to the configuration described above, an advantage is achieved in that it is easier for ink to flow into the circulating liquid chamber 65 from the communication channel 63 via the circulation channel 72 than in a configuration in which the flow channel length La or the flow channel length Lb is shorter than the flow channel length Lc.

As described above, in the first embodiment, the pressure chamber C indirectly communicates with the circulating liquid chamber 65 via the communication channel 63 and the circulation channel 72. In other words, the pressure chamber C and the circulating liquid chamber 65 do not directly communicate with each other. In the configuration described above, when the pressure in the pressure chamber C changes due to an operation of the piezoelectric element 44, a part of ink flowing in the communication channel 63 is ejected outside from the nozzle N, and a part of the rest ink flows into the circulating liquid chamber 65 from the communication channel 63 through the circulation channel 72. In the first embodiment, inertance of the communication channel 63, the nozzle, and the circulation channel 72 is selected such that an amount of ink that is ejected via the nozzle N (hereinafter, referred to as an "ejection amount") of the ink circulating in the communication channel 63 by driving the piezoelectric element 44 once is larger than an amount of ink that flows into the circulating liquid chamber 65 via the circulation channel 72 (hereinafter, referred to as a "circulation amount") of the ink circulating in the communication channel 63. This can also be described as follows. When a case of driving all of the piezoelectric elements 44 at once is assumed, a total of circulation amounts of flowing into the circulating liquid chamber 65 from the plurality of communication channels 63 (for example, a flow amount in the circulating liquid chamber 65 within a unit time) is larger than a total of ejection amounts by the plurality of nozzles N.

Specifically, the flow channel resistance of each of the communication channel 63, the nozzle, and the circulation channel 72 is determined such that a ratio of the circulation amount to the ink circulating in the communication channel 63 is equal to or higher than 70% (a ratio of the ejection amount is equal to or lower than 30%). According to the configuration described above, it is possible to effectively circulate ink in the vicinity of the nozzle to the circulating liquid chamber 65 while the ejection amount of the ink is ensured. Schematically, the higher the flow channel resistance of the circulation channel 72 is, the more the circulation amount decreases, whereas the more the ejection amount increases. The lower the flow channel resistance of the circulation channel 72 is, the more the circulation amount tends to increase, whereas the more the ejection amount decreases.

As illustrated in FIG. 5, the liquid ejecting apparatus 100 of the first embodiment includes a circulation mechanism 75. The circulation mechanism 75 is a mechanism that supplies (that is, circulates) the ink in the circulating liquid chamber 65 to the liquid reservoir R. For example, the circulation mechanism 75 of the first embodiment has a suction mechanism (for example, a pump) that suctions ink from the circulating liquid chamber 65, a filter mechanism that captures bubbles or foreign matter which is mixed with the ink, and a heating mechanism that lowers thickening by heating the ink (not shown). The circulation mechanism 75 removes the bubbles or foreign matter, and ink, of which the thickening is lowered, is supplied to the liquid reservoir R from the circulation mechanism 75 via the introduction port 482. As understood from the description provided above, in the first embodiment, the ink circulates through the liquid reservoir R, the supply channel 61, the pressure chamber C, the communication channel 63, the circulation channel 72, the circulating liquid chamber 65, the circulation mechanism 75, and the liquid reservoir R in this order.

As understood from FIG. 5, the circulation mechanism 75 of the first embodiment suctions the ink from both sides of the circulating liquid chamber 65 in the Y direction. The circulating liquid chamber 65 is provided with a circulation port 65*a* positioned in the vicinity of an end portion thereof on a positive side in the Y direction and a circulation port 65*b* positioned in the vicinity of an end portion thereof on a negative side in the Y direction. The circulation mechanism 75 suctions the ink from both the circulation port 65*a* and the circulation port 65*b*. In a configuration in which ink is suctioned only one end portion of the circulating liquid chamber 65 in the Y direction, a difference in pressure of the ink can occur between both end portions of the circulating liquid chamber 65, and the pressure of the ink in the communication channel 63 can be different depending on a position in the Y direction due to a pressure difference in the circulating liquid chamber 65. Hence, there is a possibility that an ejection characteristic (for example, the ejection amount or an ejection speed) of ink from the nozzles is different depending on a position in the Y direction. In contrast to the configuration described above, in the first embodiment, since the ink is suctioned from both sides (the circulation port 65*a* and the circulation port 65*b*) of the circulating liquid chamber 65, the pressure difference inside the circulating liquid chamber 65 decreases. Hence, it is possible to obtain approximate ejection characteristics of ink over the plurality of nozzles N arranged in the Y direction with high accuracy. However, in a case where the pressure difference in the circulating liquid chamber 65 in the Y direction is not particularly high, it is also possible to employ a configuration in which the ink is suctioned from one end portion of the circulating liquid chamber 65.

As described above, the circulation channel 72 and the communication channel 63 overlap each other in a plan view, and the communication channel 63 and the pressure chamber C overlap each other in a plan view. Hence, the circulation channel 72 and the pressure chamber C overlap each other in a plan view. On the other hand, as understood from FIGS. 5 and 6, the circulating liquid chamber 65 and the pressure chamber C do not overlap each other in a plan view. In addition, since the piezoelectric element 44 is formed over the entire pressure chamber C along the X direction, the circulation channel 72 and the piezoelectric element 44 overlap each other in a plan view, but the circulating liquid chamber 65 and the piezoelectric element 44 do not overlap each other in a plan view. As understood from the description provided above, the pressure chamber C or the piezoelectric element 44 overlaps the circulation channel 72 in a plan view but does not overlap the circulating liquid chamber 65 in a plan view. Hence, an advantage is achieved in that it is easier to decrease the liquid ejecting head 26 in size than in a configuration in which the pressure chamber C or the piezoelectric element 44 does not overlap the circulation channel 72 in a plan view, for example.

As described above, in the first embodiment, the circulation channel 72 through which the communication channel 63 and the circulating liquid chamber 65 communicate with each other is formed in the nozzle plate 52. Hence, compared with a configuration in PTL 1 in which a circulating communication channel is formed in a communication plate, it is possible to more efficiently circulate the ink in the vicinity of the nozzle N to the circulating liquid chamber 65. In addition, in the first embodiment, the communication channels 63 corresponding to the first array L1 and the communication channels 63 corresponding to the second array L2 commonly communicate with the circulating liquid chamber 65 between both the communication channels. Hence, an advantage is achieved in that a configuration of the liquid ejecting head 26 is more simplified (therefore, miniaturization is realized) than in a configuration in which a circulating liquid chamber communicating with the circulation channels 72 corresponding to the first array L1 is separately provided from a circulating liquid chamber communicating with the circulation channels 72 corresponding to the second array L2.

Second Embodiment

A second embodiment of the present invention is described. Elements having the same operations or functions in aspects, which will be exemplified below, as those in the first embodiment are assigned with the same reference signs used in the description of the first embodiment, and thus the detailed descriptions thereof are appropriately omitted.

Figure 7:
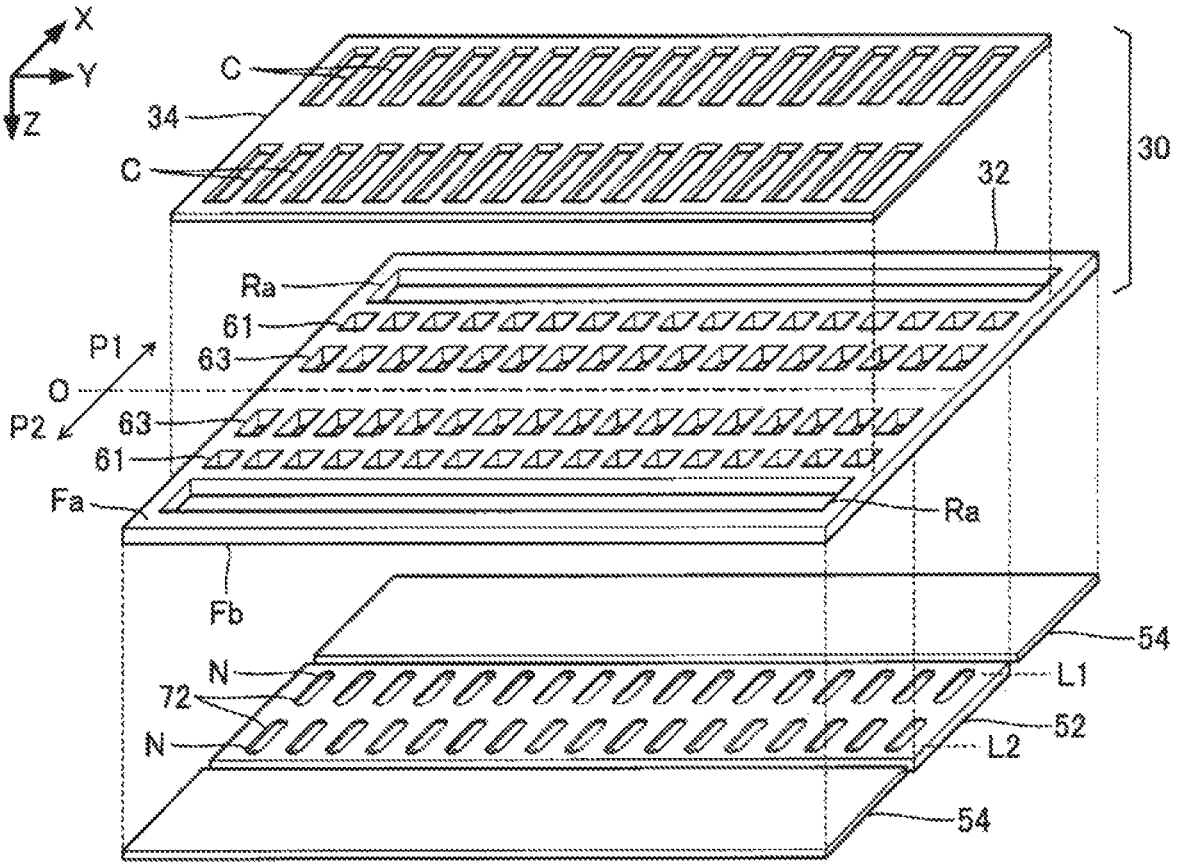
FIG. 7 is a partially exploded perspective view of a liquid ejecting head according to a second embodiment.
Figure 8:
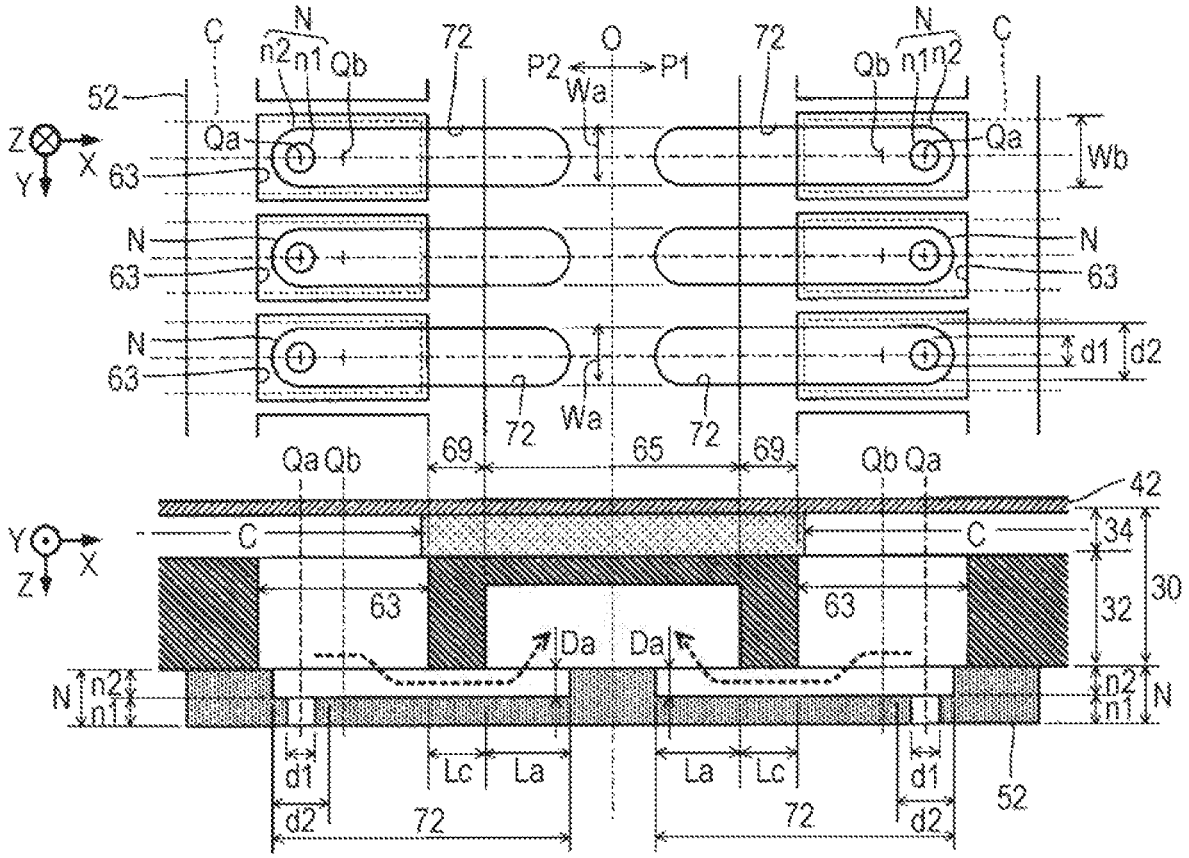
FIG. 8 shows a plan view and a sectional view in the vicinity of a circulating liquid chamber according to the second embodiment.

FIG. 7 is a partially exploded perspective view of the liquid ejecting head 26 according to the second embodiment and corresponds to FIG. 3 referred to in first embodiment. In addition, FIG. 8 shows an enlarged plan view and an enlarged sectional view of a portion in the vicinity of the circulating liquid chamber 65 of the liquid ejecting head 26 and corresponds to FIG. 6 referred to in the first embodiment.

In the first embodiment, a configuration in which the circulation channel 72 and the nozzle N are separated from each other is exemplified. In the second embodiment, as understood from FIGS. 7 and 8, the circulation channel 72 and the nozzle N are continuous to each other. In other words, one circulation channel 72 in the first portion P1 is continuous to one nozzle N of the first array L1, one circulation channel 72 in the second portion P2 is continuous to one nozzle N of the second array L2. Specifically, as illustrated in FIG. 8, the second zones n2 of the nozzles N are continuous to the circulation channels 72, respectively. In other words, the circulation channel 72 and the second zone n2 are formed to have the same depth as each other, and an inner peripheral surface of the circulation channel 72 and an inner peripheral surface of the second zone n2 are continuous to each other. In other words, it is possible to employ a configuration in which the nozzle N (first zone n1) is formed on the bottom surface of one circulation channel 72 extending in the X direction. Specifically, the first zone n1 of the nozzle N is formed in the vicinity of an end portion of the bottom surface of the circulation channel 72 on the opposite side of the center plane O. The other configurations are the same as those of the first embodiment. For example, also in the second embodiment, the flow channel length La of a portion of the circulation channel 72, which overlaps the circulating liquid chamber 65 is longer than a flow channel length Lc of a portion of the circulation channel 72, which overlaps the partition wall 69 of the flow channel forming unit 30 (La>Lc).

Also in the second embodiment, the same effects as those of the first embodiment are realized. In addition, in the second embodiment, the second zones n2 of the nozzles N and the circulation channels 72 are continuous to each other. Hence, compared with the configuration of the first embodiment in which the circulation channel 72 and the nozzle N are separated from each other, an effect is particularly remarkable in that it is possible to efficiently circulate the ink in the vicinity of the nozzle N to the circulating liquid chamber 65.

Third Embodiment

Figure 9:
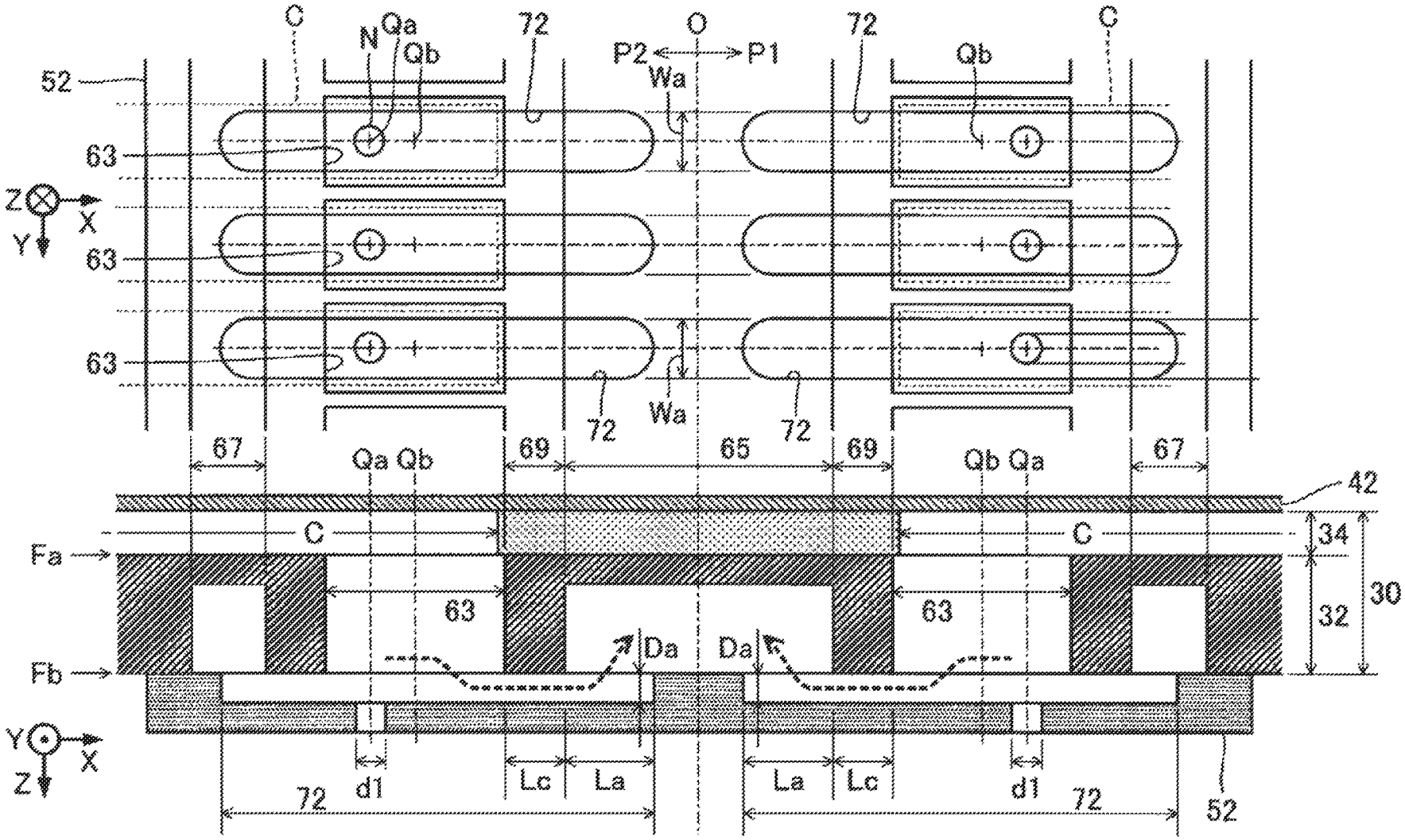
FIG. 9 shows a plan view and a sectional view in the vicinity of a circulating liquid chamber according to a third embodiment.

FIG. 9 shows an enlarged plan view and an enlarged sectional view of a portion in the vicinity of the circulating liquid chamber 65 of the liquid ejecting head 26 according to a third embodiment. As illustrated in FIG. 9, a circulating liquid chamber 67 (exemplifying a second circulating liquid chamber) corresponding to each of the first portion P1 and the second portion P2 is formed, in addition to the same circulating liquid chamber 65 (exemplifying the first circulating liquid chamber) as that in the first embodiment described above, on the front surface Fb of the first flow channel substrate 32 in the third embodiment. The circulating liquid chamber 67 is a bottomed hole (groove) having an elongated shape which is formed on the opposite side of the circulating liquid chamber 65 with the communication channel 63 and the nozzle N interposed therebetween and extends in the Y direction. The nozzle plate 52 joined to the front surface Fb of the first flow channel substrate 32 blocks an opening of each of the circulating liquid chamber 65 and the circulating liquid chamber 67. A height of the circulating liquid chamber 65 is equal to a height of the circulating liquid chamber 67.

The circulation channel 72 of the third embodiment is a groove that extends in the X direction over the circulating liquid chamber 65 and the circulating liquid chamber 67 in each of the first portion P1 and the second portion P2. Specifically, an end portion of the circulation channel 72 on the side (side of the circulating liquid chamber 65) of the center plane O overlaps the circulating liquid chamber 65 in a plan view, and an end portion of the circulation channel 72 on the opposite side (side of the circulating liquid chamber 67) of the center plane O overlaps the circulating liquid chamber 67 in a plan view. In addition, the circulation channel 72 overlaps the communication channel 63 in a plan view. In other words, the communication channels 63 communicate with both the circulating liquid chamber 65 and the circulating liquid chamber 67 via the circulation channels 72.

In other words, the nozzle N (first zone n1) is formed on the bottom surface of the circulation channel 72. Specifically, the first zone n1 of the nozzle N is formed on the bottom surface of a portion of the circulation channel 72, which overlaps the communication channel 63 in a plan view. Similarly to the second embodiment, also in the third embodiment, it is possible to realize a configuration in which the circulation channel 72 and the nozzle N (second zone n2) are continuous to each other. As understood from the description provided above, the communication channel 63 and the nozzle N are positioned on the end portion of the circulation channel 72 in the first and second embodiments, and the communication channel 63 and the nozzle N are positioned in an intermediate portion of the circulation channel 72 extending in the X direction in the third embodiment.

As understood from the description provided above, in the third embodiment, when the pressure in the pressure chamber C changes in the pressure chamber C, a part of ink flowing in the communication channel 63 is ejected outside from the nozzle N, and a part of the rest ink is supplied to both the circulating liquid chamber 65 and the circulating liquid chamber 67 from the communication channel 63 through the circulation channel 72. The ink in the circulating liquid chamber 67 and the ink in the circulating liquid chamber 65 are together suctioned by the circulation mechanism 75. Then, after bubbles or foreign matter is removed by the circulation mechanism 75, and thickening is lowered, the ink is supplied to the liquid reservoir R.

Also in the third embodiment, the same effects as those of the first embodiment are realized. In addition, in the third embodiment, in addition to the circulating liquid chamber 65, the circulating liquid chamber 67 is formed, and thus an advantage is achieved in that it is possible to ensure sufficient circulation amount more than in the first embodiment. FIG. 9 illustrates a configuration in which the circulation channel 72 and the nozzle N are continuous to each other similarly to the second embodiment; however, in the third embodiment, it is possible to separate the circulation channel 72 and the nozzle N from each other similarly to the first embodiment.

Fourth Embodiment

Figure 10:
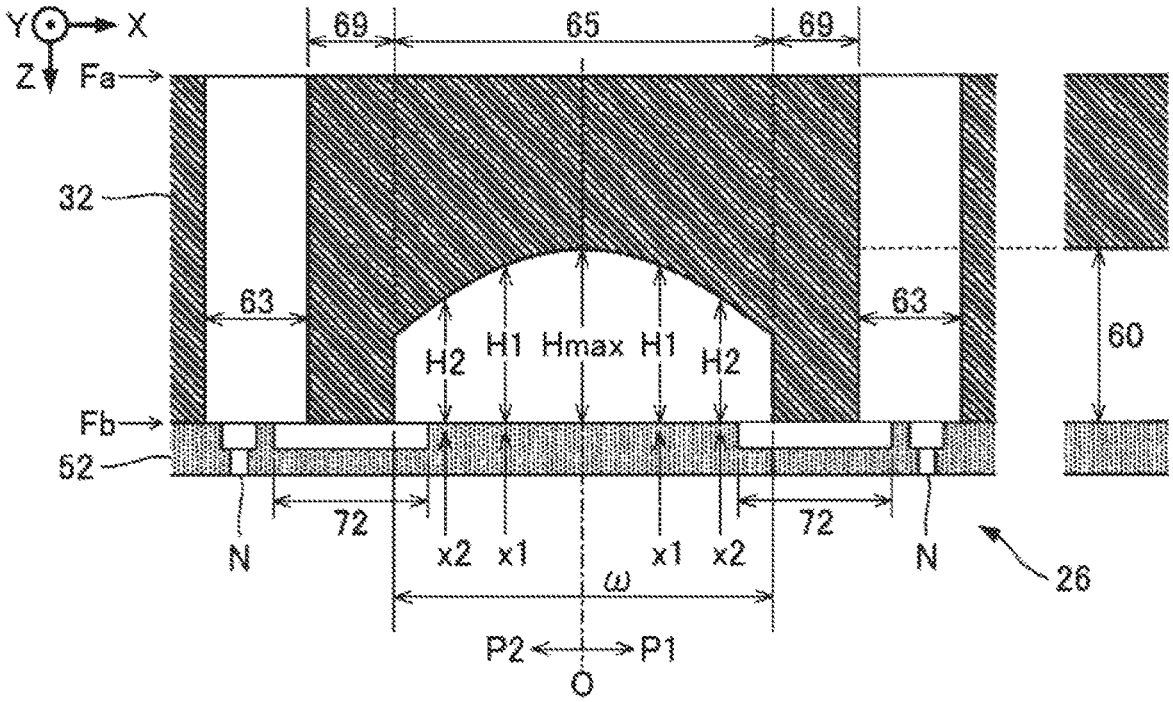
FIG. 10 shows a sectional view in the vicinity of a circulating liquid chamber according to a fourth embodiment.

FIG. 10 shows an enlarged sectional view of a portion in the vicinity of the circulating liquid chamber 65 of the liquid ejecting head 26 according to a fourth embodiment. In the first to third embodiments, configurations in which the circulating liquid chamber 65 has the upper surface (ceiling surface) parallel to the X-Y plane (that is, configurations in which the circulating liquid chamber 65 has a constant height) are exemplified. In the fourth embodiment, as illustrated in FIG. 10, a height H (H1, H2, or Hmax) of the circulating liquid chamber 65 is different depending on a position in the X direction. The height H of the circulating liquid chamber 65 is a distance from the front surface Fb of the first flow channel substrate 32 (or the front surface of the nozzle plate 52) to the upper surface of the circulating liquid chamber 65. In a case where the circulating liquid chamber 65 is considered as a cavity formed on the front surface Fb of the first flow channel substrate 32, a depth of the circulating liquid chamber 65 viewed from the surface Fb can be considered as the height H.

As illustrated in FIG. 10, a location x1 (exemplifying a first location) and a location x2 (exemplifying a second location) which are different in position in the X direction are assumed in each of the first portion P1 and the second portion P2. The location x2 is positioned on the side of the communication channel 63 (that is, an opposite side of the center plane O) when viewed from the location x1. As illustrated in FIG. 10, in the fourth embodiment, the height H1 of the circulating liquid chamber 65 at the location x1 is larger than the height H2 at the location x2 (H1>H2). Specifically, the height H of the circulating liquid chamber 65 has the maximum value Hmax at a center portion (on the center plane O) in the X direction and monotonically decreases from the center portion toward end portions in a width direction (X direction). In other words, the upper surface of the circulating liquid chamber 65 is plane-symmetrical with respect to the center plane O, and has a curved shape that is convex on the negative side in the Z direction. This can also be described as follows. The partition wall 69 has a configuration in which a thickness thereof increases toward the negative side in the Z direction.

As understood from FIG. 10, the maximum value Hmax of the height H of the circulating liquid chamber 65 is smaller than a flow channel length of the communication channel 63 (that is, a thickness of the first flow channel substrate 32). Specifically, the maximum value Hmax of the height H of the circulating liquid chamber 65 is equal to or smaller than a half of the thickness of the first flow channel substrate 32. In addition, the maximum value Hmax of the height H of the circulating liquid chamber 65 is smaller than a width (maximum width) ω of the circulating liquid chamber 65 (Hmax<ω). As described above, when employing a configuration in which the height H of the circulating liquid chamber 65 is limited, it is possible to limit a reduction in mechanical strength of the flow channel forming unit 30 (specifically, the first flow channel substrate 32).

In addition, as understood from FIG. 10, the maximum value Hmax of the height H of the circulating liquid chamber 65 is equal to the height of the liquid supply chamber 60. The circulating liquid chamber 65 and the liquid supply chamber 60 are formed by processing a silicon (Si) monocrystalline substrate by using a semiconductor manufacturing technology (for example, wet etching). In the fourth embodiment, since the maximum value Hmax of the height H of the circulating liquid chamber 65 is equal to the height of the liquid supply chamber 60, an advantage is achieved in that a process of forming the circulating liquid chamber 65 and the liquid supply chamber 60 is more simplified than in a configuration in which the heights of both chambers are different from each other.

Fifth Embodiment

Figure 11:
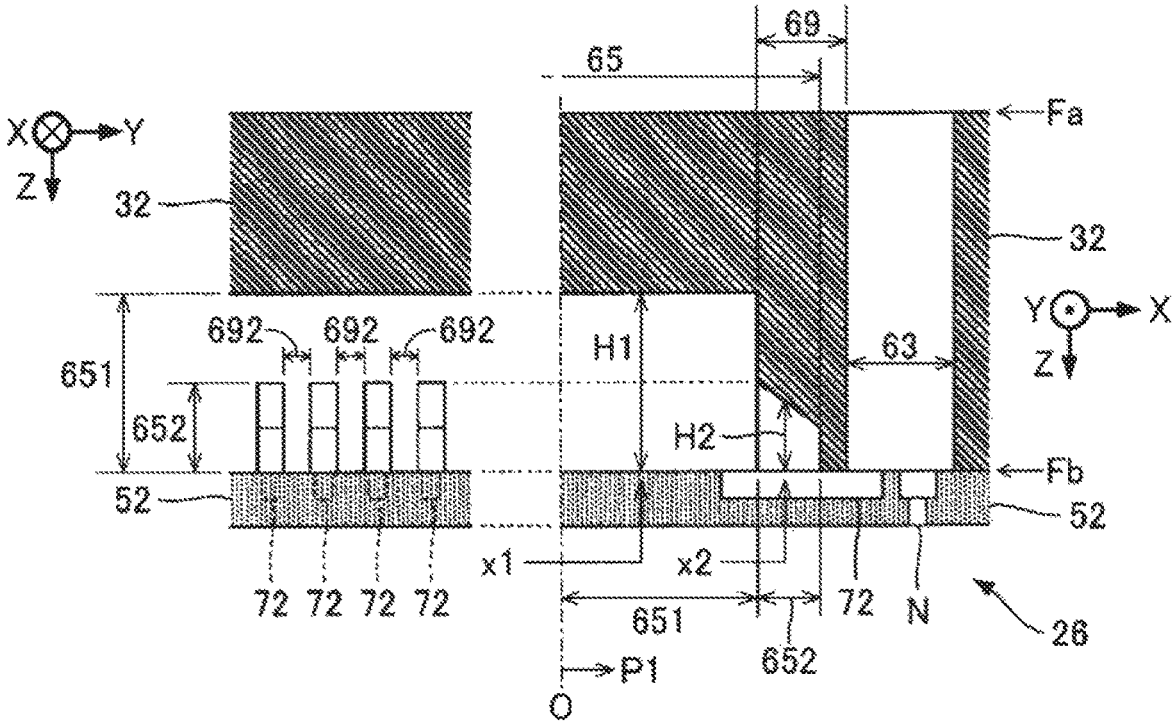
FIG. 11 shows a sectional view in the vicinity of a circulating liquid chamber according to a fifth embodiment.

FIG. 11 shows an enlarged sectional view of a portion in the vicinity of the circulating liquid chamber 65 of the liquid ejecting head 26 according to a fifth embodiment. A section parallel to an X-Z plane is shown on the right side in FIG. 11, and a configuration in which a section (section parallel to a Y-Z plane) on the center plane O is viewed from the negative side in the X direction is shown on the left side in FIG. 11.

As illustrated in FIG. 11, the circulating liquid chamber 65 of the fifth embodiment is configured of a first space 651 and a plurality of second spaces 652. The first space 651 is formed into the same shape as the circulating liquid chamber 65 in the first to third embodiments. Specifically, an upper surface of the first space 651 in the fifth embodiment is parallel to the X-Y plane, similarly to the circulating liquid chamber 65 of the first to third embodiments. The height H1 of the first space 651 is equal to or smaller than the thickness of the first flow channel substrate 32, for example, and is smaller than a width (maximum width) of the first space 651.

The plurality of second spaces 652 are formed to correspond to the plurality of communication channels 63, respectively, and communicate with the first space 651. A second space 652 corresponding to any one communication channel 63 overlaps the circulation channel 72 corresponding to the communication channel 63 in a plan view. Hence, ink in the communication channels 63 is supplied to the first space 651 via the circulation channel 72 and the second space 652 and is circulated to the liquid reservoir R by the circulation mechanism 75. FIG. 11 shows only a portion on the positive side in the X direction when viewed from the center plane O for descriptive purposes; however, the same configuration in plane symmetry with respect to the center plane O is formed also on the negative side in the X direction when viewed from the center plane O.

The upper surface of the second space 652 is an inclined surface having a height H that decreases from the negative side (side of the first space 651) toward the positive side (side of the communication channel 63) in the X direction. In addition, a flow channel wall 692 is formed between the two spaces 652 adjacent to each other in the Y direction. The flow channel walls 692 are partition wall-shaped portions of the second spaces 652. A wall (part of the partition wall 69) having a constant thickness is formed between the second spaces 652 and the communication channels 63.

As understood from FIG. 11, the height of the first space 651 is larger than the height of the second space 652. As illustrated in FIG. 11, when a location x1 (exemplifying the first location) in the first space 651 and any location x2 in the second space 652 are assumed, the height H1 at the location x1 in the circulating liquid chamber 65 is larger than the height H2 at the location x2 (H1>H2). The location x2 is a location positioned on the side of the communication channel 63 when viewed from the location x1. As understood from the description provided above, according to the fifth embodiment, it is possible to more limit a reduction in mechanical strength of the flow channel forming unit 30 (specifically, the first flow channel substrate 32) than in a configuration in which the height of the entire circulating liquid chamber 65 (both the first space 651 and the second space 652) is set to the height H1.

Modification Example of Fifth Embodiment

Figure 12:
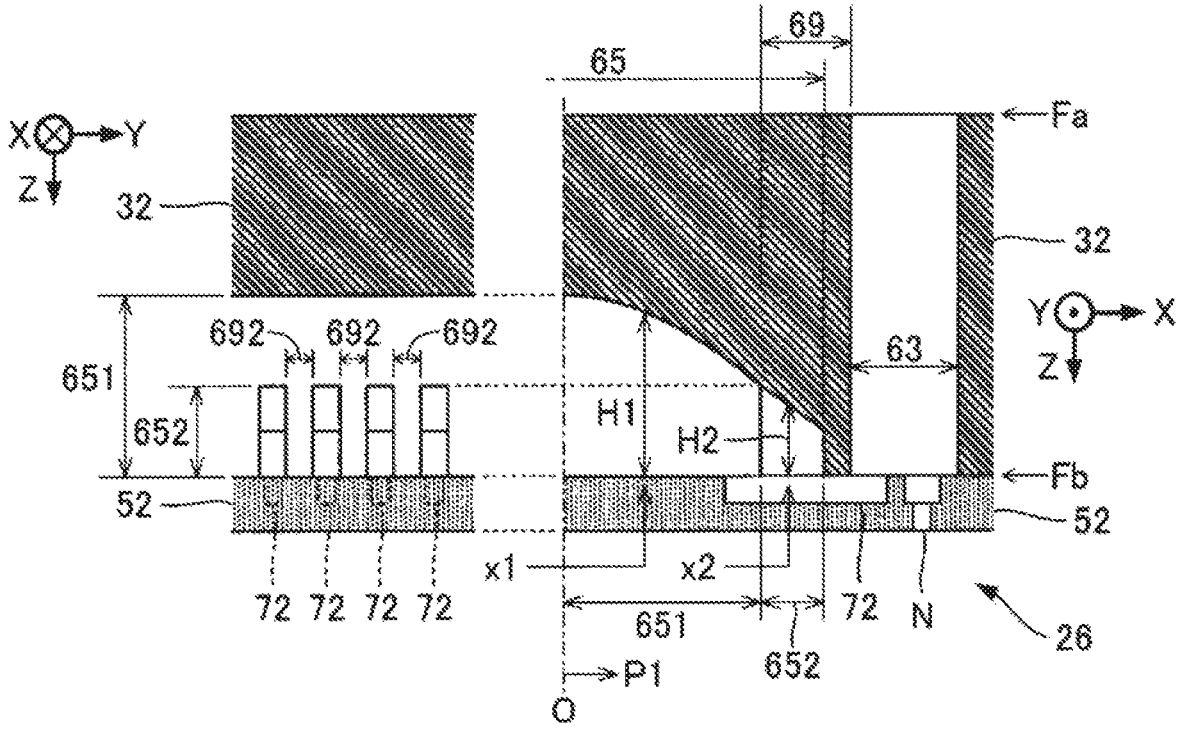
FIG. 12 shows a sectional view in the vicinity of a circulating liquid chamber according to a modification example of the fifth embodiment.

FIG. 11 illustrates a configuration in which the upper surface of the first space 651 of the circulating liquid chamber 65 is parallel to the X-Y plane; however, the first space 651 in the fifth embodiment can have the same shape as the circulating liquid chamber 65 of the fourth embodiment (FIG. 10). For example, the circulating liquid chamber 65 illustrated in FIG. 12 is configured of the first space 651 and the plurality of second spaces 652, and the first space 651 is formed into a shape with a height H that is different depending on a position in the X direction. For example, the height H of the first space 651 monotonically decreases from the center portion toward the end portions in the width direction (X direction).

Sixth Embodiment

Figure 13:
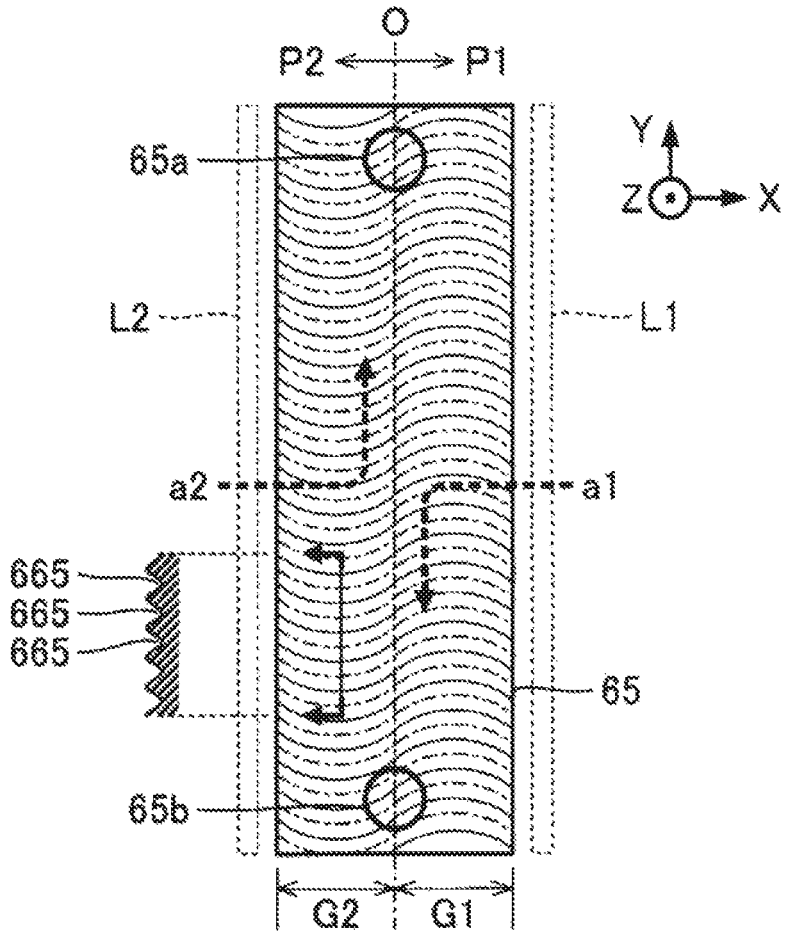
FIG. 13 shows a plan view of a circulating liquid chamber according to a sixth embodiment.

FIG. 13 shows a plan view focusing on the vicinity of the circulating liquid chamber 65 of the liquid ejecting head 26 according to a sixth embodiment. A configuration when the circulating liquid chamber 65 is viewed from the positive side in the Z direction (that is, the upper surface of the circulating liquid chamber 65) is shown in FIG. 13. Similarly to the fourth embodiment (FIG. 10), the circulating liquid chamber 65 of the sixth embodiment is formed into a shape in which the height H of the circulating liquid chamber 65 is different depending on a position in the X direction. In other words, the height H of the circulating liquid chamber 65 monotonically decreases from the center portion toward the end portions in the width direction (X direction).

As illustrated in FIG. 13, a plurality of grooves 665 are formed in parallel on the upper surface of the circulating liquid chamber 65. Each of the plurality of grooves 665 is a cavity extending in a curved shape in a plan view. In other words, since a crest portion is formed between the grooves 665 adjacent to each other, it is possible to employ a configuration in which a plurality of crest portions having a curved shape in a plan view are formed on the upper surface of the circulating liquid chamber 65. In FIG. 13, a curve representing the groove 665 formed on the upper surface of the circulating liquid chamber 65 is drawn in a solid line, an a curve (that is, a ridge line) representing a top portion of the crest portion is drawn in a dashed line. For example, the plurality of grooves 665 are formed by the same process as that of the circulating liquid chamber 65 by using a processing technology such as wet etching. The plurality of grooves 665 can also be formed in any circulating liquid chamber 65 exemplified in the first to fifth embodiments. For example, in the fifth embodiment, the plurality of grooves 665 are formed on the upper surface of the first space 651 of the circulating liquid chamber 65.

As illustrated in FIG. 13, in the sixth embodiment, the plurality of grooves 665 arranged in the Y direction are formed in each of a region G1 on the positive side in the X direction and a region G2 on the negative side in the X direction of the upper surface of the circulating liquid chamber 65 when viewed from the center plane O. The region G1 is a region on a side of the nozzles N (exemplifying the first nozzle) of the first array L1, and the region G2 is a region on a side of the nozzles N (exemplifying the second nozzle) of the second array L2.

Each of the plurality of grooves 665 in the region G1 is formed into a curved shape that is convex on the positive side in the Y direction (exemplifying a first side in a first direction) in a plan view. For example, the plurality of grooves 665 having an arc shape that is convex on the positive side in the Y direction are formed in the region G1. On the other hand, each of the plurality of grooves 665 in the region G2 is formed into a curved shape that is convex on the negative side in the Y direction (exemplifying a second side in the first direction) in a plan view. For example, the plurality of grooves 665 having the arc shape that is convex on the negative side in the Y direction are formed in the region G2.

Ink that flows into the circulating liquid chamber 65 and reaches the vicinity of the upper surface of the circulating liquid chamber 65 is likely to move along the grooves 665. In other words, according to the sixth embodiment, it is possible to adjust a range in which the ink in the circulating liquid chamber 65 flows.

For example, the grooves 665 in the region G1 are convex on the positive side in the Y direction. Hence, the ink that flows into the circulating liquid chamber 65 from the communication channel 63 (that is, on the positive side in the X direction) in the first portion P1 is likely to flow toward the negative side (side of the circulation port 65*b*) in the Y direction along the grooves 665 in the region G1, as shown by an arrow a1 in FIG. 13. On the other hand, the grooves 665 in the region G2 are convex on the negative side in the Y direction. Hence, the ink that flows into the circulating liquid chamber 65 from the communication channel 63 (that is, on the negative side in the X direction) in the second portion P2 is likely to flow toward the positive side (side of the circulation port 65*a*) in the Y direction along the grooves 665 in the region G2, as shown by an arrow a2 in FIG. 13. As understood from the description provided above, according to the sixth embodiment, an advantage is achieved in that it is easy to cause the ink to flow toward both end sides of the circulating liquid chamber 65.

Modification Example of Sixth Embodiment

Figure 14:
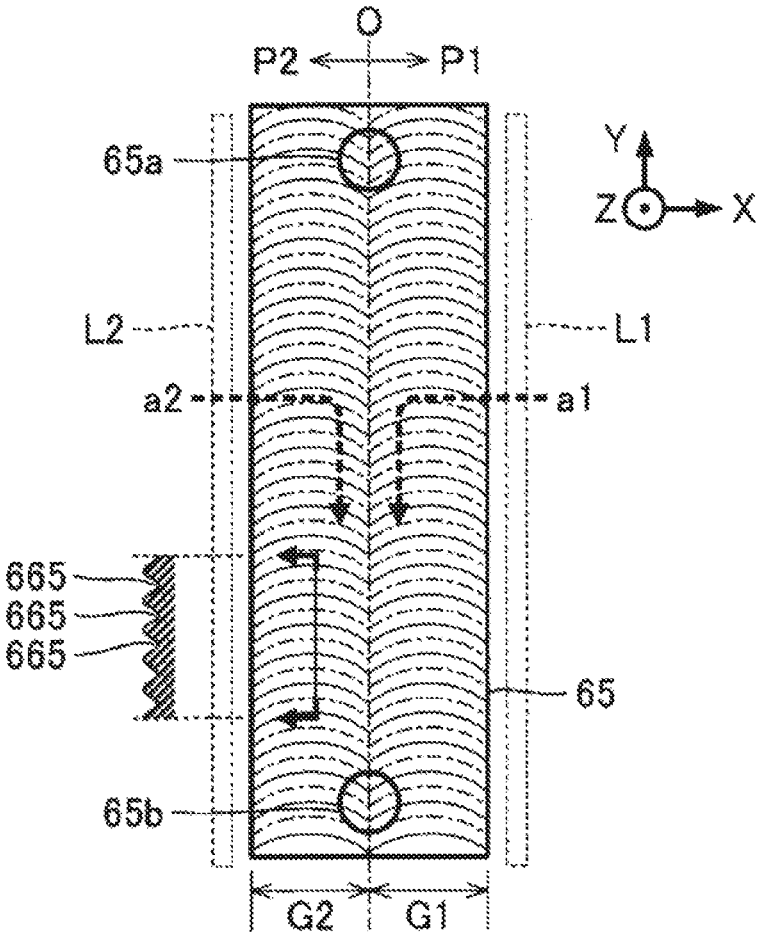
FIG. 14 shows a plan view of a circulating liquid chamber according to a modification example of the sixth embodiment.

As illustrated in FIG. 14, both the grooves 665 in the region G1 and the grooves 665 in the region G2 can be formed into a curved shape that is convex on the positive side in the Y direction (exemplifying the first side in the first direction). According to the configuration in FIG. 14, an advantage is achieved in that it is easy to cause both the ink flowing into the circulating liquid chamber 65 from the communication channel 63 of the first portion P1 and the ink flowing into the circulating liquid chamber 65 from the communication channel 63 of the second portion P2 to flow toward the negative side in the Y direction, as shown by the arrow a1 and the arrow a2 in FIG. 14. In the configuration described above, it is possible to omit the circulation port 65*a* of the circulating liquid chamber 65.

Figure 15:
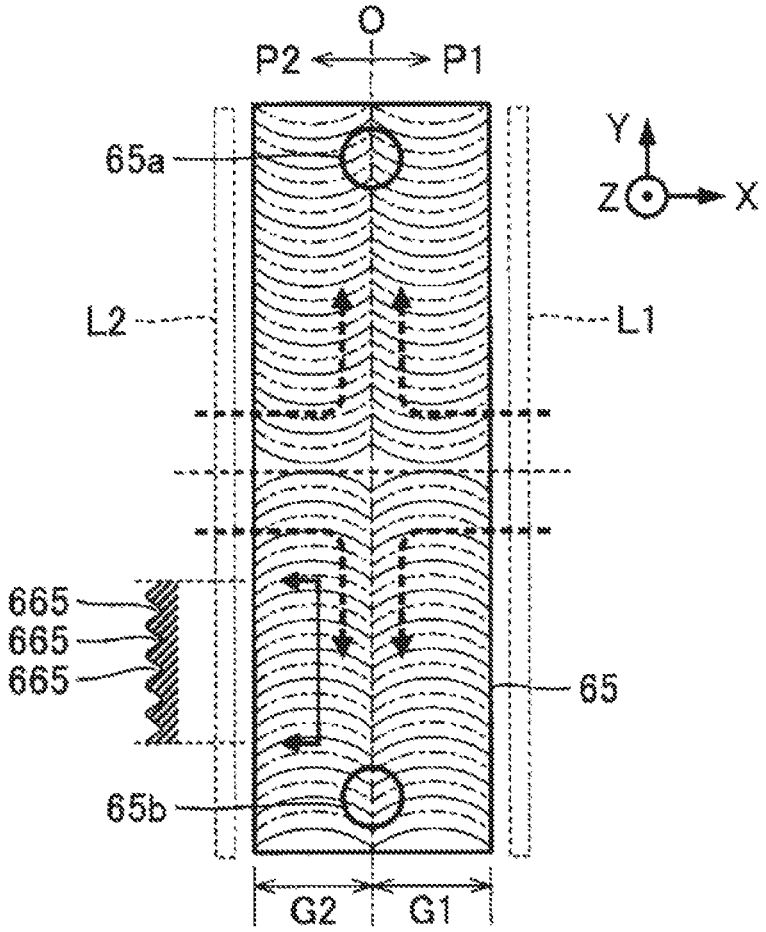
FIG. 15 shows a plan view of a circulating liquid chamber according to another modification example of the sixth embodiment.

In addition, as illustrated in FIG. 15, it is also possible to employ a configuration in which the grooves 665 positioned on the positive side in the Y direction and the grooves 665 positioned on the negative side are convex in opposite directions. Specifically, the grooves 665 in a region on the positive side in the Y direction (for example, a half region positioned on the positive side in the Y direction) of the circulating liquid chamber 65 are convex on the negative side in the Y direction in a plan view. On the other hand, the grooves 665 in a region on the negative side in the Y direction (for example, a half region positioned on the negative side in the Y direction) of the circulating liquid chamber 65 are convex on the positive side in the Y direction in a plan view. According to the configuration described above, an advantage is achieved in that ink that flows into the portion on the positive side in the Y direction of the circulating liquid chamber 65 is likely to flow toward the positive side in the Y direction (therefore, the circulation port 65*a*), and ink that flows into the portion on the negative side in the Y direction of the circulating liquid chamber 65 is likely to flow toward the negative side in the Y direction (therefore, the circulation port 65*b*).

Seventh Embodiment

Figure 16:
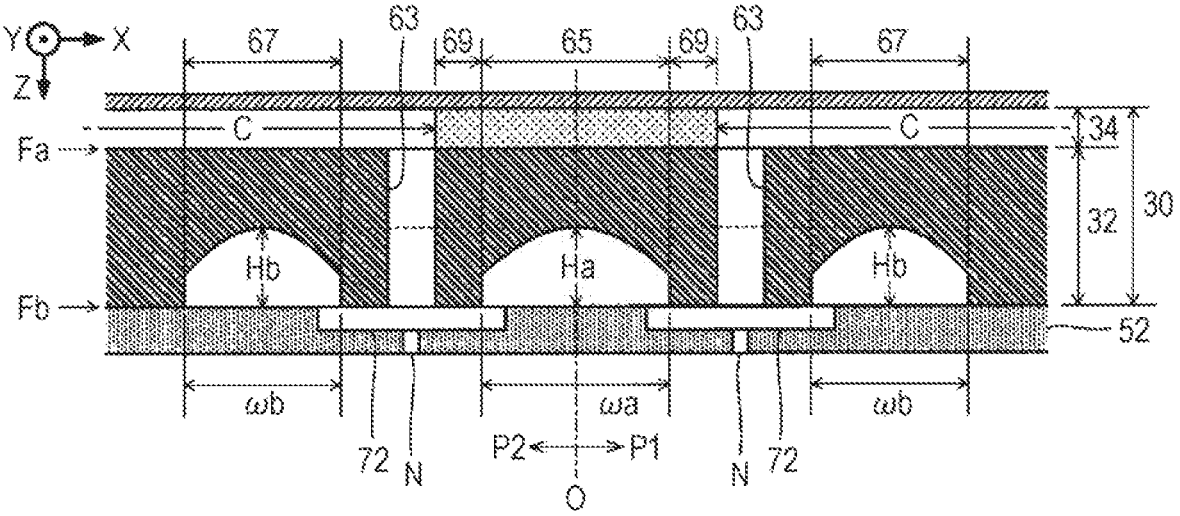
FIG. 16 shows a sectional view in the vicinity of a circulating liquid chamber according to a seventh embodiment.

FIG. 16 shows a sectional view of the liquid ejecting head 26 according to a seventh embodiment. As illustrated in FIG. 16, similarly to the third embodiment (FIG. 9), the circulating liquid chamber 67 (exemplifying the second circulating liquid chamber) corresponding to each of the first portion P1 and the second portion P2 is formed, in addition to the circulating liquid chamber 65 (exemplifying the first circulating liquid chamber), in the first flow channel substrate 32 in the liquid ejecting head 26 of the seventh embodiment. The circulating liquid chamber 67 is a space having an elongated shape which is formed on the opposite side of the circulating liquid chamber 65 with the communication channel 63 and the nozzle N interposed therebetween and extends in the Y direction. According to the configuration described above, as described above in the third embodiment, it is possible to more increase the circulation amount of ink than in a configuration in which only the circulating liquid chamber 65 is formed.

As understood from FIG. 16, the circulating liquid chamber 65 does not overlap the pressure chamber C in a plan view, but the circulating liquid chamber 67 overlaps the pressure chamber C in a plan view. According to the configuration described above, an advantage is achieved in that it is easier to maintain the mechanical strength of the pressure chamber C than in a configuration in which both the circulating liquid chamber 65 and the circulating liquid chamber 67 overlap the pressure chamber C. As illustrated in FIG. 16, a width (dimension in the X direction) $\omega a$ of the circulating liquid chamber 65 is wider than a width $\omega b$ of the circulating liquid chamber 67 ($\omega a > \omega b$).

As illustrated in FIG. 16, in the seventh embodiment, similarly to the circulating liquid chamber 65 of the fourth embodiment, heights of both the circulating liquid chamber 65 and the circulating liquid chamber 67 are different depending on a position in the X direction. For example, the heights of the circulating liquid chamber 65 and the circulating liquid chamber 67 monotonically decrease from the center portion toward the end portions in the width direction. In addition, as illustrated in FIG. 16, a maximum value Ha of the height of the circulating liquid chamber 65 is equal to a maximum value Hb of the height of the circulating liquid chamber 67. Hence, an advantage is achieved in that a process of forming the circulating liquid chamber 65 and the circulating liquid chamber 67 is more simplified than in a configuration in which heights of the circulating liquid chamber 65 and the circulating liquid chamber 67 are different from each other. The shape of the circulating liquid chamber 65 of the fifth embodiment, which is configured of the first space 651 and the second space 652, can be similarly applied to the circulating liquid chamber 67 of the seventh embodiment.

Modification Example of Seventh Embodiment

Figure 17:
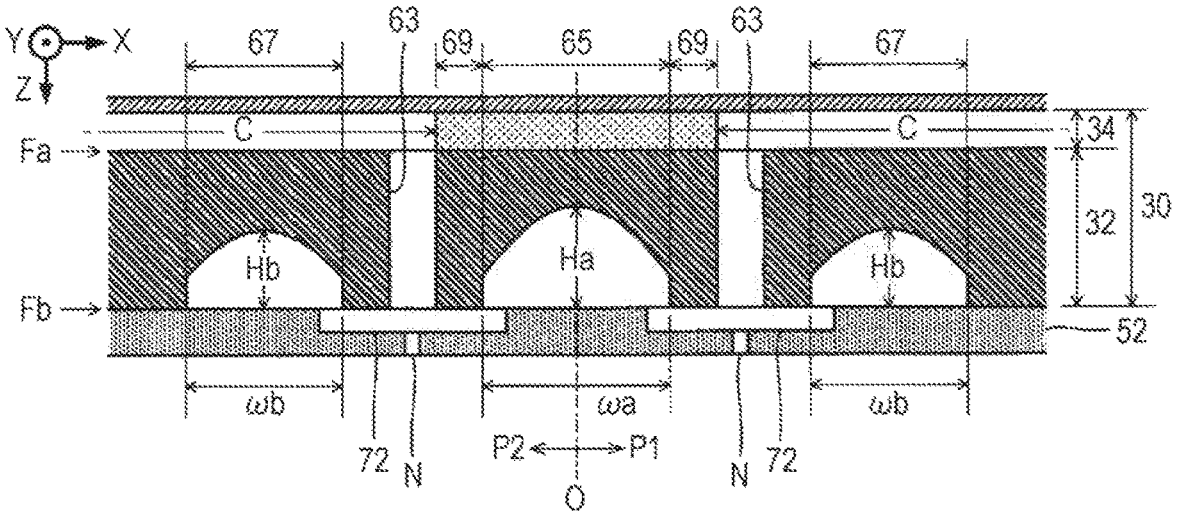
FIG. 17 shows a sectional view in the vicinity of a circulating liquid chamber according to a modification example of the seventh embodiment.

As illustrated in FIG. 17, the maximum value Ha of the height of the circulating liquid chamber 65 can be larger than the maximum value Hb of the height of the circulating liquid chamber 67 (Ha>Hb). According to the configuration in FIG. 17, an advantage is achieved in that, since the pressure chamber C and the circulating liquid chamber 67 are separated from each other, it is easier to maintain the mechanical strength of the pressure chamber C than in a configuration (FIG. 16) in which the maximum value Ha is equal to the maximum value Hb.

Figure 18:
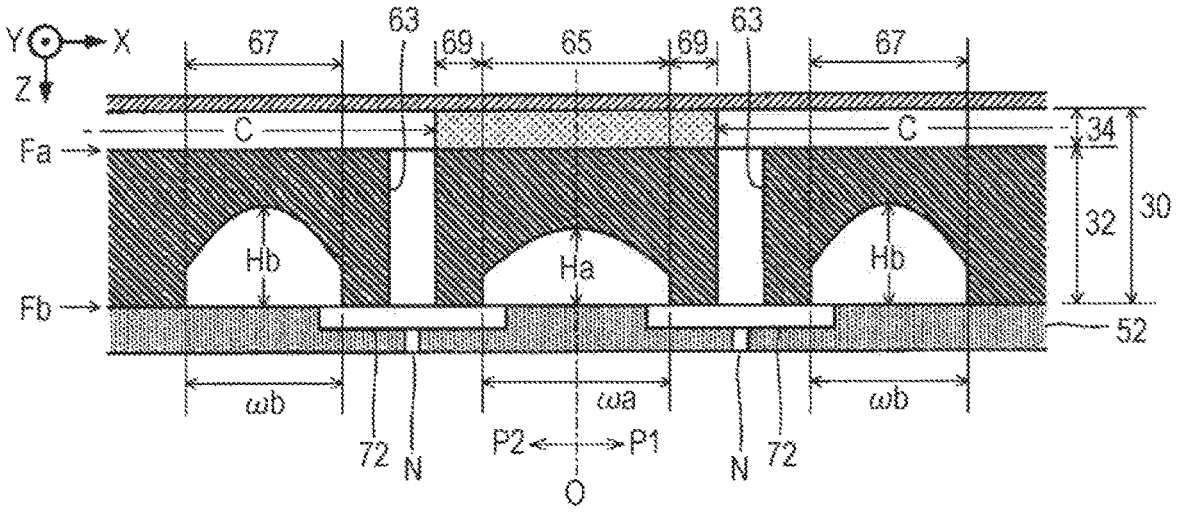
FIG. 18 shows a sectional view in the vicinity of a circulating liquid chamber according to another modification example of the seventh embodiment.

As illustrated in FIG. 18, the maximum value Ha of the height of the circulating liquid chamber 65 can be smaller than the maximum value Hb of the height of the circulating liquid chamber 67 (Ha<Hb). According to the configuration in FIG. 18, an advantage is achieved in that it is easier to maintain the mechanical strength of the flow channel forming unit 30 against an external force that presses the first flow channel substrate 32 in the Z direction during mounting of the wiring substrate 28 than in the configuration (FIG. 16) in which the maximum value Ha is equal to the maximum value Hb.

Figure 19:
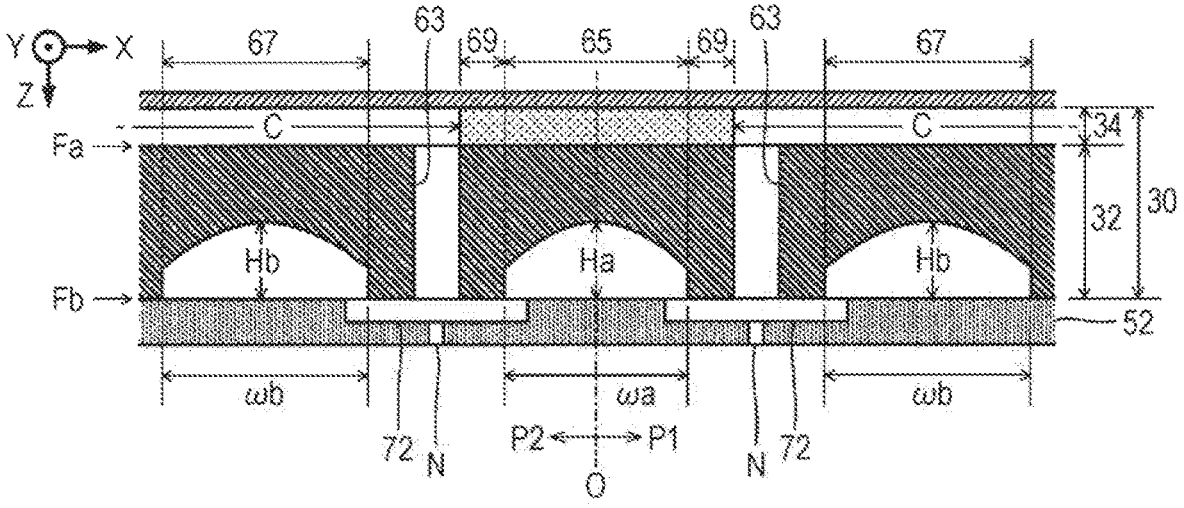
FIG. 19 shows a sectional view in the vicinity of a circulating liquid chamber according to still another modification example of the seventh embodiment.

As illustrated in FIG. 19, the width (dimension in the X direction) ωa of the circulating liquid chamber 65 can be narrower than the width ωb of the circulating liquid chamber 67 (ωa<ωb). It is possible to employ the configuration (FIG. 16) in which the width ωa of the circulating liquid chamber 65 is wider than the width ωb of the circulating liquid chamber 67 and the configuration (FIG. 19) in which the width ωa of the circulating liquid chamber 65 is narrower than the width ωb of the circulating liquid chamber 67, regardless of shapes of the circulating liquid chamber 65 and the circulating liquid chamber 67.

Regarding Fourth to Seventh Embodiments

Any configuration of the first to third embodiments can be employed as configurations that are not particularly mentioned in the description provided above regarding the fourth to seventh embodiments. For example, the configurations of the first to third embodiments related to the circulation channel 72 or the nozzle N can be applied to any example selected from the fourth to seventh embodiments. In the first to third embodiments, the circulation channel 72 is formed in the nozzle plate 52; however, in the fourth to seventh embodiments, the circulation channel, through which the communication channel 63 and the circulating liquid chamber 65 communicate with each other, can be formed in the first flow channel substrate 32 (for example, the front surface Fb).

In the fourth to seventh embodiments, the height of the circulating liquid chamber 65 is different depending on a position in the X direction. According to the configuration described above, it is possible to more limit a reduction in mechanical strength of the flow channel forming unit 30 than in the configurations of the first to third embodiments in which the upper surface of the circulating liquid chamber 65 is parallel to the X-Y plane. In the fourth to seventh embodiments, the circulating liquid chamber 65 overlaps the end portion of the wiring substrate 28 in a plan view. In the configuration described above, the first flow channel substrate 32 is pressed in the Z direction during the mounting of the wiring substrate 28. The configurations of the fourth to seventh embodiments in which it is possible to ensure the mechanical strength of the flow channel forming unit 30 are particularly effective from the viewpoint of preventing the first flow channel substrate 32 from being broken or the like due to the press during the mounting of the wiring substrate 28. In a configuration in which the circulating liquid chamber 65 has a corner, bubbles mixed in ink are likely to remain in the corner. According to the configuration in which the upper surface of the circulating liquid chamber 65 has the curved shape as in the fourth embodiment, remaining of the bubbles is limited, and thus it is possible to effectively discharge the bubbles mixed in the ink.

Modification Examples

The embodiments described above can be modified in various ways. Specific modification examples that can be applied to the embodiments described above are described as follows. Two or more examples optionally selected from below can be appropriately combined within a range in which the examples are compatible with each other.

Figure 20:
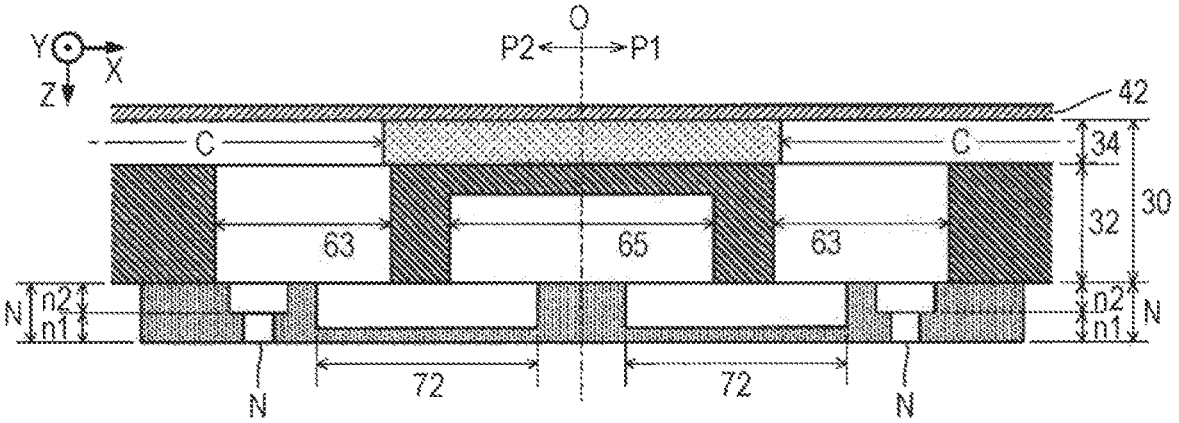
FIG. 20 shows a sectional view in the vicinity of a circulating liquid chamber in a liquid ejecting head according to a modification example.
Figure 21:
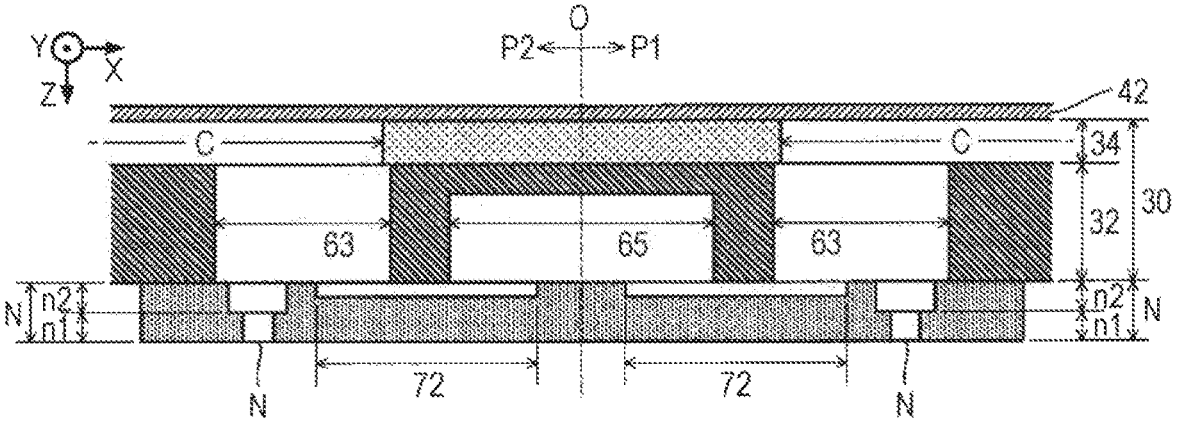
FIG. 21 shows a sectional view in the vicinity of a circulating liquid chamber in a liquid ejecting head according to another modification example.

(1) In the embodiments described above, the configuration in which the circulation channel 72 and the second zone n2 of the nozzle N have the same depth is exemplified; however, a relationship between the depth of the circulation channel 72 and the depth of the second zone n2 is not limited to that described above. For example, it is possible to employ a configuration in which the circulation channel 72 deeper than the second zone n2 is formed as illustrated in FIG. 20 or a configuration in which the circulation channel 72 shallower than the second zone n2 is formed as illustrated in FIG. 21. According to the configuration in FIG. 20, the flow channel resistance of the circulation channel 72 is lower than that in the configuration in FIG. 21, and thus it is possible to more increase the circulation amount than in the configuration in FIG. 21. On the other hand, according to the configuration in FIG. 21, the flow channel resistance of the circulation channel 72 is higher than that in the configuration in FIG. 20, and thus it is possible to more increase the ejection amount than in the configuration in FIG. 20.

Figure 22:
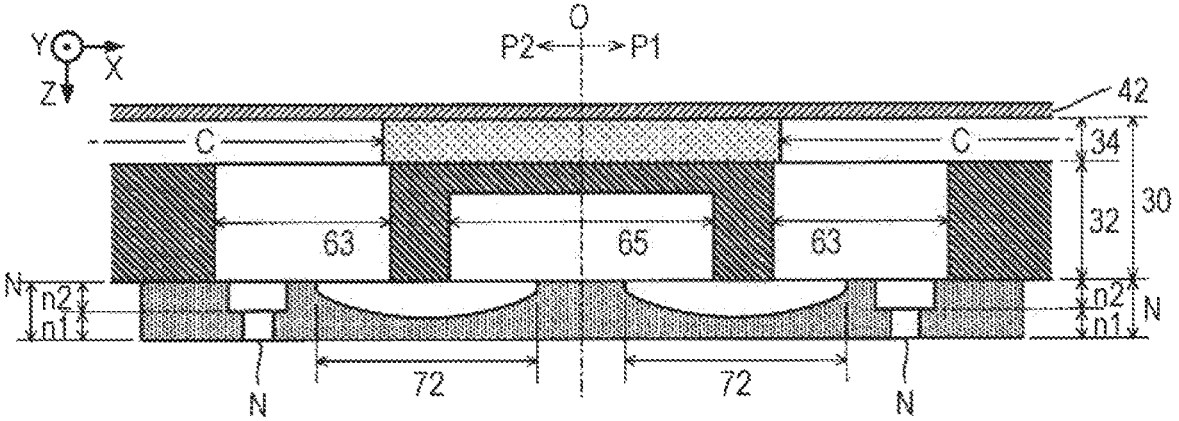
FIG. 22 shows a sectional view in the vicinity of a circulating liquid chamber in a liquid ejecting head according to still another modification example.

(2) In the embodiments described above, the configuration in which the depth Da of the circulation channel 72 is constant is exemplified; however, it is possible to change the depth of the circulation channel 72 depending on a position in the X direction. For example, as illustrated in FIG. 22, a configuration in which an intermediate portion (for example, a portion that overlaps the partition wall 69 in a plan view) of the circulation channel 72 is deeper than a portion on the side of the circulating liquid chamber 65 and a portion on the side of the nozzle N when viewed from the intermediate portion is assumed. According to the configuration in FIG. 22, the flow channel resistance of the circulation channel 72 is lower than that in the configuration in which the depth Da of the circulation channel 72 is constant over the entire length. Hence, an advantage is achieved in that it is easy to ensure the circulation amount.

(3) In the embodiments described above, the configuration in which the flow channel width Wa of the circulation channel 72 is equal to the maximum diameter of the nozzle N (the inner diameter d2 of the second zone n2) is exemplified; however, the flow channel width Wa is not limited to that described above. For example, it is also possible to employ a configuration in which the flow channel width Wa of the circulation channel 72 is smaller than the maximum diameter of the nozzle N (the inner diameter d2 of the second zone n2). According to the configuration described above, the flow channel resistance of the circulation channel 72 is higher than that in the configuration in which the circulation channel 72 is larger than the maximum diameter of the nozzle N. Hence, it is possible to increase the ejection amount. In addition, it is also possible to employ a configuration in which the flow channel width Wa of the circulation channel 72 is larger than the inner diameter d1 of the first zone n1). According to the configuration described above, ensuring of the circulation amount is compatible with ensuring of the ejection amount.

Figure 23:
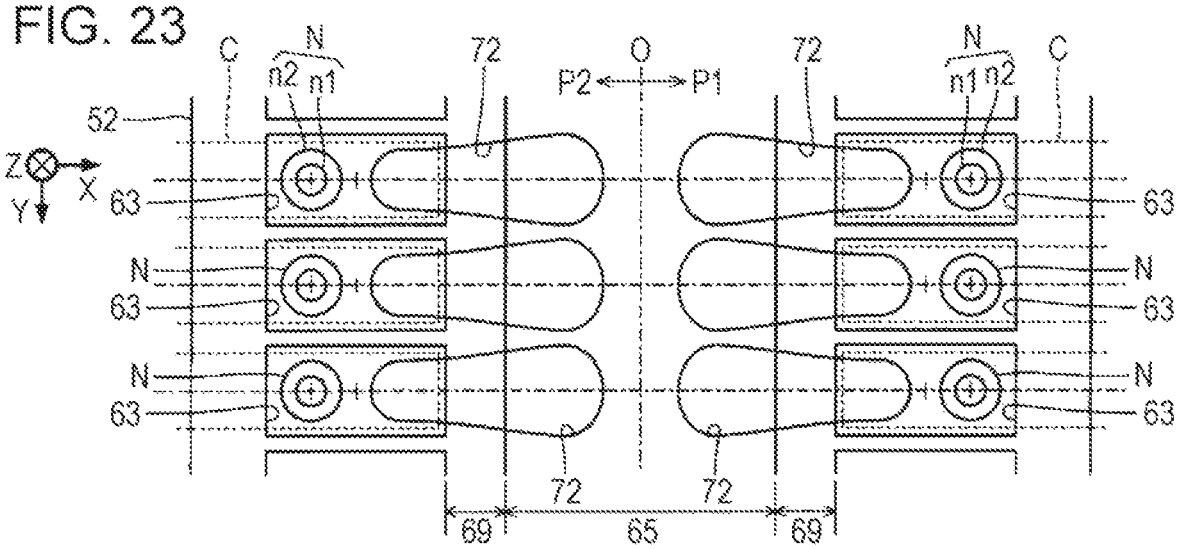
FIG. 23 shows a plan view in the vicinity of a circulating liquid chamber in a liquid ejecting head according to still another modification example.

(4) In the embodiments described above, the configuration in which the flow channel width Wa of the circulation channel 72 is constant is formed; however, it is possible to change the flow channel width of the circulation channel 72 depending on a position in the X direction. For example, as illustrated in FIG. 23, it is possible to employ a configuration in which a flow channel width of a portion of the circulation channel 72 on the side of the circulating liquid chamber 65 is wider than a flow channel width thereof on the side of the nozzle N. Specifically, the circulation channel 72 is formed to have a planar shape in which the flow channel width of the circulation channel 72 monotonically increases from an end portion thereof on the side of the nozzle to an end portion thereof on the side of the circulating liquid chamber 65. According to a configuration in FIG. 23, ink easily flows through the circulation channel 72 from the communication channel 63 toward the circulating liquid chamber 65. Hence, an advantage is achieved in that it is easy to ensure the circulation amount.

Figure 24:
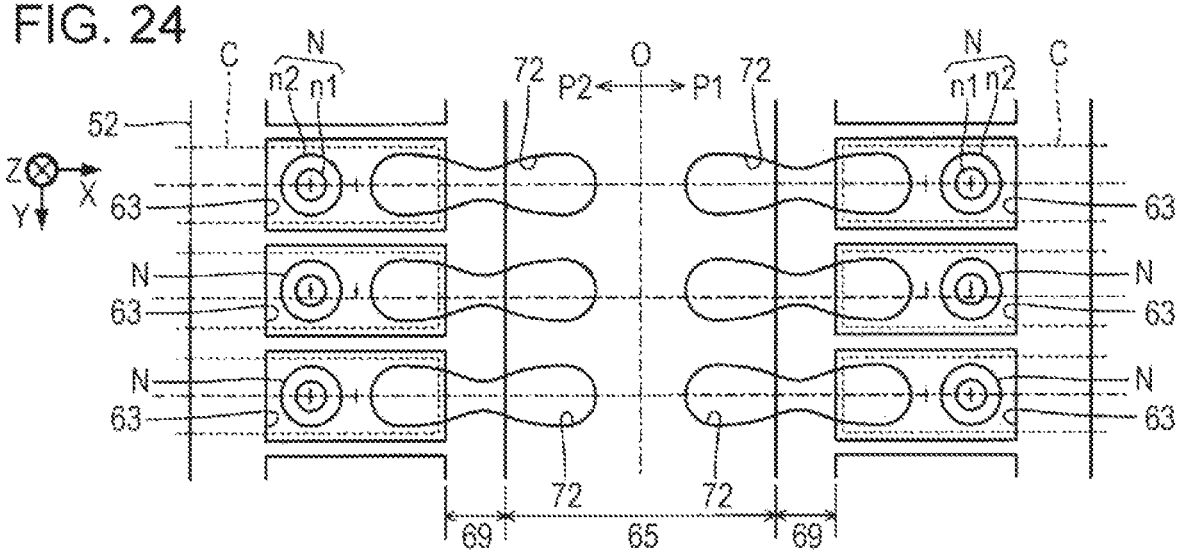
FIG. 24 shows a plan view in the vicinity of a circulating liquid chamber in a liquid ejecting head according to still another modification example.

In addition, as illustrated in FIG. 24, it is also possible to employ a configuration in which a flow channel width of the intermediate portion (for example, the portion that overlaps the partition wall 69 in a plan view) of the circulation channel 72 is narrower than a flow channel width of a portion on the side of the circulating liquid chamber 65 and a flow channel width of a portion on the side of the nozzle N when viewed from the intermediate portion. In other words, the flow channel width monotonically decreases from both end portions toward the intermediate portion of the circulation channel 72 such that a portion (for example, the portion that overlaps the partition wall 69 in a plan view) on the circulation channel 72 has the minimum flow channel width. According to the configuration in FIG. 24, the flow channel resistance of the circulation channel 72 is higher than that in the configuration in which the flow channel width of the circulation channel 72 is constant. Hence, it is possible to increase the ejection amount.

Figure 25:
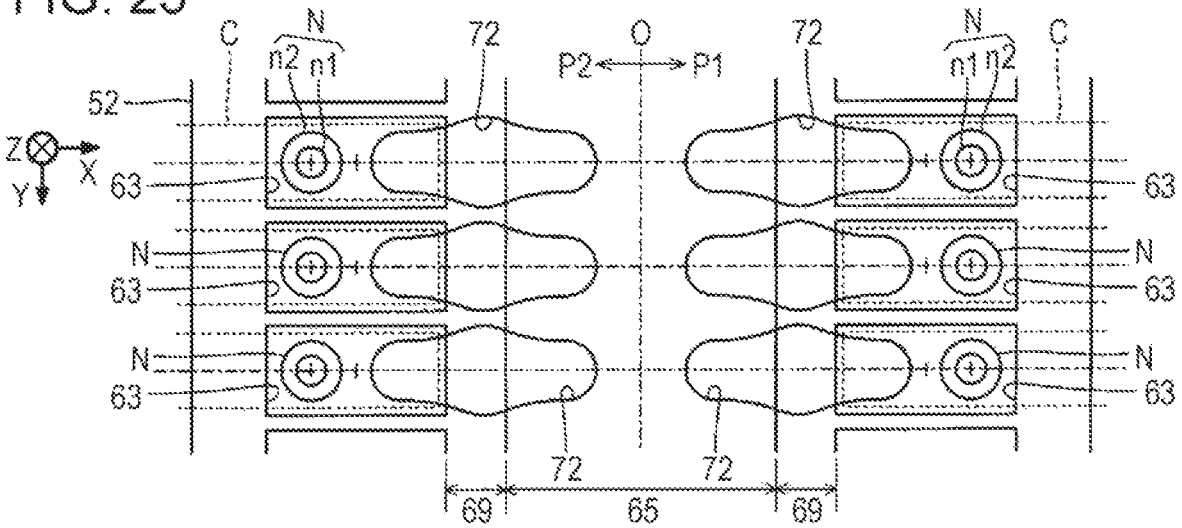
FIG. 25 shows a plan view in the vicinity of a circulating liquid chamber in a liquid ejecting head according to still another modification example.

As illustrated in FIG. 25, it is also possible to employ a configuration in which the flow channel width of the intermediate portion (for example, the portion that overlaps the partition wall 69 in a plan view) of the circulation channel 72 is wider than the flow channel width of the portion on the side of the circulating liquid chamber 65 and the flow channel width of the portion on the side of the nozzle N when viewed from the intermediate portion. In other words, the flow channel width monotonically increases from both end portions toward the intermediate portion of the circulation channel 72 such that a portion (for example, the portion that overlaps the partition wall 69 in a plan view) on the circulation channel 72 has the maximum flow channel width. According to the configuration in FIG. 25, the flow channel resistance of the circulation channel 72 is lower than that in the configuration in which the flow channel width of the circulation channel 72 is constant. Hence, it is possible to increase the circulation amount.

It is necessary to form the thick partition wall 69 in order to ensure the mechanical strength of the partition wall 69 of the first flow channel substrate 32. However, the thicker the partition wall 69 (the longer the flow channel length Lc) is, the more the flow channel resistance of the circulation channel 72 increases. According to a configuration in FIG. 25, even in a case where the thickness of the partition wall 69 is ensured to the extent that sufficient strength is realized, an advantage is achieved in that the intermediate portion of the circulation channel 72 becomes wider, and thereby it is possible to decrease the flow-path resistance of the circulation channel 72. In other words, ensuring of the strength of the partition wall 69 can be compatible with the reduction in flow channel resistance of the circulation channel 72.

Figure 26:
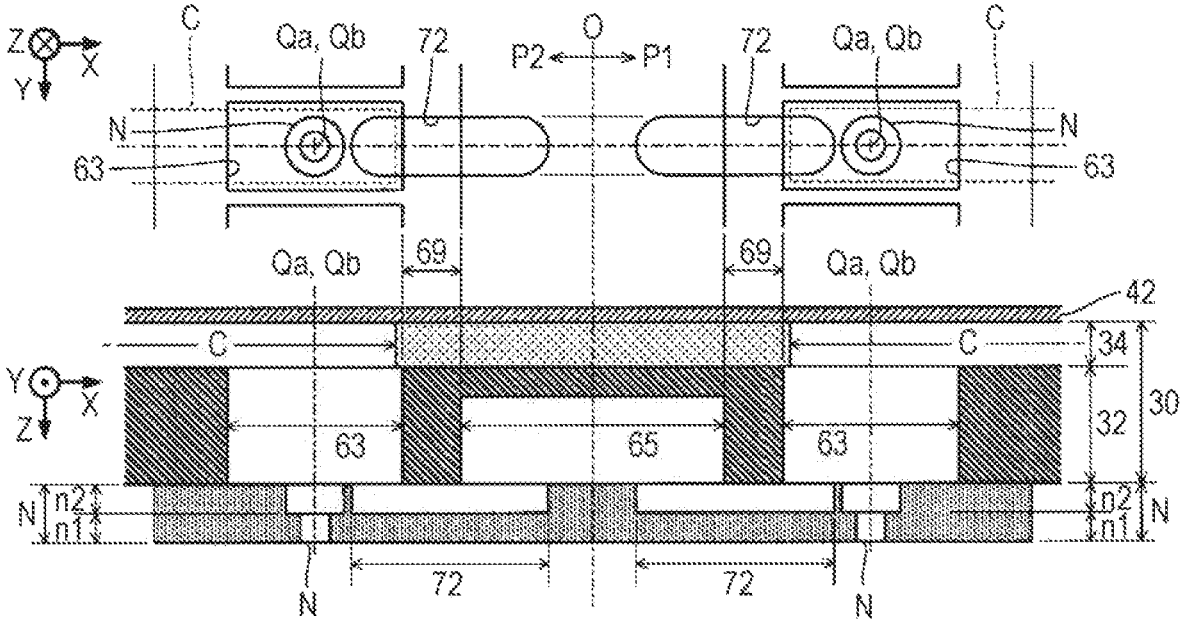
FIG. 26 shows a plan view and a sectional view in the vicinity of a circulating liquid chamber of a liquid ejecting head according to still another modification example.

(5) In the embodiments described above, the configuration in which the center axis Qa of the nozzle N is positioned on the opposite side of the circulating liquid chamber 65 when viewed from the center axis Qb of the communication channel 63 is exemplified; however, a relationship between the center axis Qa of the nozzle N and the center axis Qb of the communication channel 63 is not limited to that described above. For example, as illustrated in FIG. 26, the center axis Qa of the nozzles N can be positioned at the same position as the center axis Qb of the communication channels 63. According to a configuration in FIG. 26, an advantage is achieved in that the ensuring of the ejection amount is more easily compatible with the ensuring of the circulation amount than in a configuration in which the center axis Qa and the center axis Qb are positioned at different locations from each other.

Figure 27:
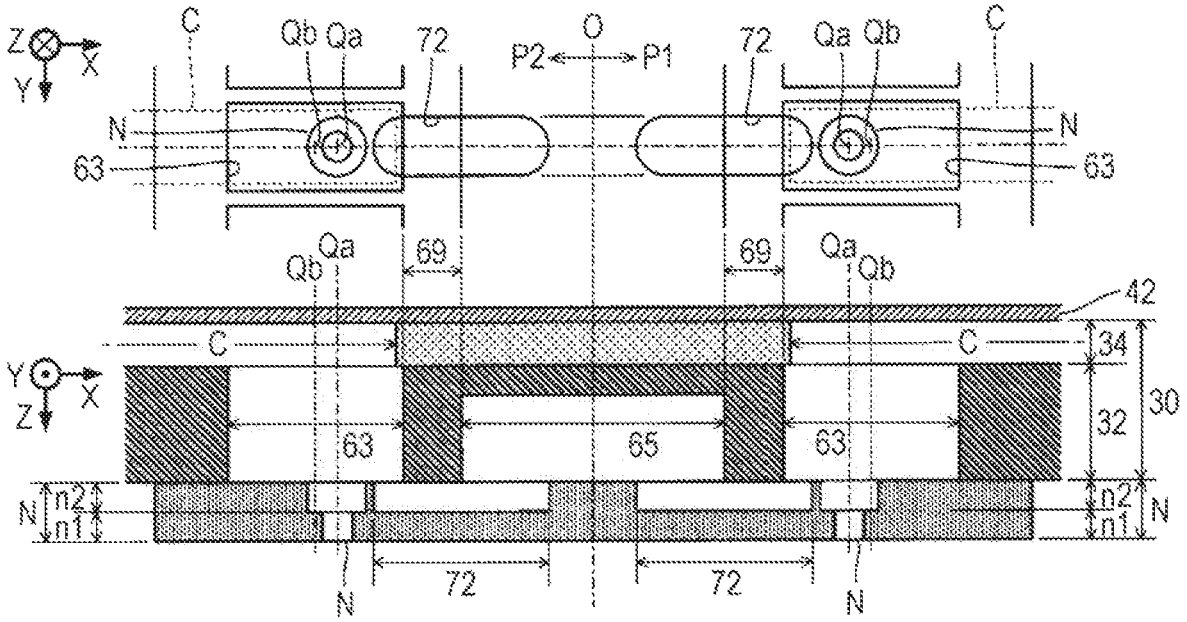
FIG. 27 shows a plan view and a sectional view in the vicinity of a circulating liquid chamber of a liquid ejecting head according to still another modification example.

In addition, as illustrated in FIG. 27, it is possible to employ a configuration in which the center axis Qa of the nozzles N is positioned on the side (side of center plane O) of the circulating liquid chamber 65 when viewed from the center axis Qb of the communication channels 63. According to a configuration in FIG. 27, it is possible to increase the circulation amount and decrease the ejection amount more than in the configuration (for example, the first embodiment) in which the center axis Qa of the nozzle N is positioned on the opposite side of the circulating liquid chamber 65 when viewed from the center axis Qb of the communication channel 63. On the other hand, according to the configuration in which the center axis Qa of the nozzle N is positioned on the opposite side of the circulating liquid chamber 65 when viewed from the center axis Qb of the communication channel 63 as in the embodiments described above, it is possible to decrease the circulation amount and increase the ejection amount more than in the configuration in FIG. 27.

Figure 28:
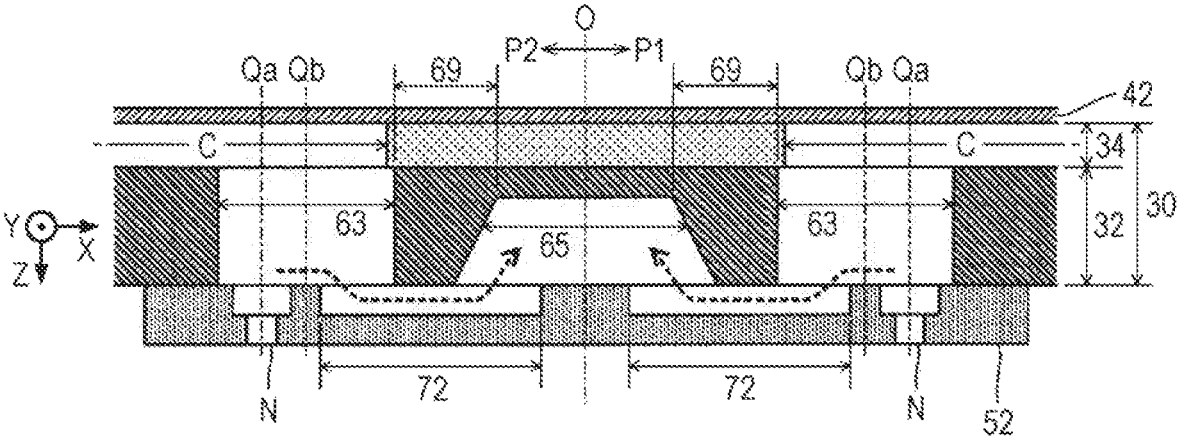
FIG. 28 shows a sectional view in the vicinity of a circulating liquid chamber in a liquid ejecting head according to still another modification example.

(6) In the fourth to seventh embodiments, the configuration in which the upper surface of the circulating liquid chamber 65 or the circulating liquid chamber 67 is curved is exemplified; however, a shape for making the height of the circulating liquid chamber 65 or the circulating liquid chamber 67 different depending on a position is not limited to that described above. For example, as illustrated in FIG. 28, the upper surface of the circulating liquid chamber 65 can be formed into a combined shape of a front surface parallel to the X-Y plane and a front surface having an inclined shape with respect to the X-Y plane, for example. Specifically, the inclined surface that configures the upper surface of the circulating liquid chamber 65 is inclined with respect to the X-Y plane such that the flow channel width (dimension in the X direction) of the circulating liquid chamber 65 increases toward a position on the positive side in the Z direction. The following description focuses on the circulating liquid chamber 65; however, the circulating liquid chamber 67 can employ the same shape.

Figure 29:
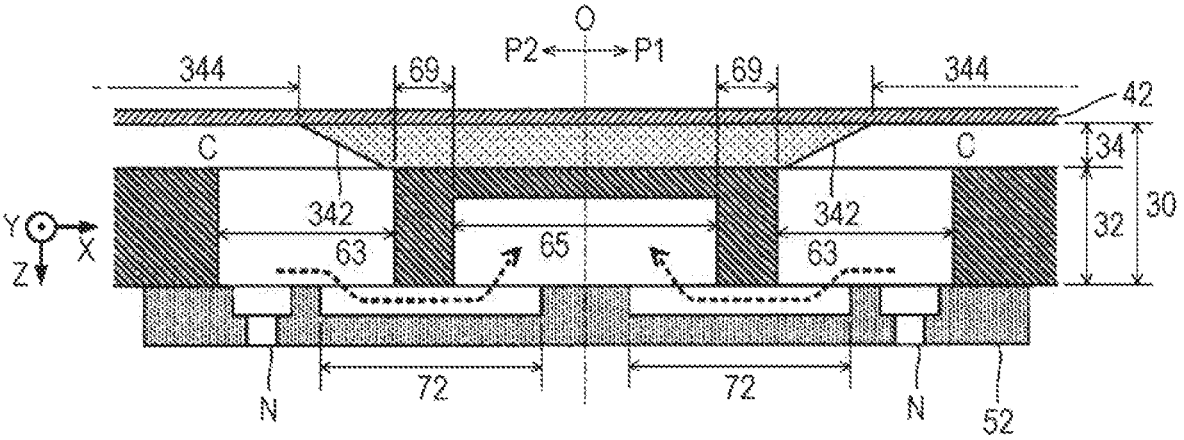
FIG. 29 shows a sectional view in the vicinity of a circulating liquid chamber in a liquid ejecting head according to still another modification example.

(7) As illustrated in FIG. 29, it is preferable to employ a configuration in which an end surface of the pressure chamber C on the side of the communication channel 63 (the side of the center plane O) is configured of an inclined surface 342 inclined with respect to the upper surface of the pressure chamber C (the upper surface of the vibrating unit 42). As understood from FIG. 29, a region (region that is not covered with the inclined surface 342) 344 of the vibrating unit 42, which is exposed from the second flow channel substrate 34, does not overlap the circulation channel 72 in a plan view. The region 344 in FIG. 29 configures the upper surface (ceiling surface) of the pressure chamber C.

(8) In the embodiments described above, the configuration in which the elements related to the first array L1 are disposed in plane symmetry with the elements related to the second array L2 with the center plane O interposed therebetween is exemplified; however, there is no need to employ the plane-symmetrical configuration. For example, it is also possible to employ a configuration in which the elements corresponding only to the first array L1 are arranged in the same manner as in the embodiments described above. In addition, in the embodiments described above, the configuration in which the circulation channel 72 is formed in the nozzle plate 52 is exemplified; however, the flow channels, through which the communication channels 63 and the circulating liquid chamber 65 communicate with each other, can be formed in the flow channel forming unit 30 (for example, the front surface Fb of the first flow channel substrate 32).

(9) An element (pressure generating unit) that applies the pressure to the inside of the pressure chamber C is not limited to the piezoelectric element 44 exemplified in the embodiments described above. For example, it is also possible to use, as the pressure generating unit, a heating element that generates bubbles inside the pressure chamber C through heating and changes the pressure. The heating element is a portion (specifically, a region that generates bubbles in the pressure chamber C) in which a heating body is heated by supply of a drive signal. As understood from the description provided above, the pressure generating unit is collectively referred to as an element that ejects, from the nozzle N, a liquid in the pressure chamber C (typically, an element that applies pressure to the inside of the pressure chamber C), regardless of an operation method (piezoelectric method/heading method) or a specific configuration.

(10) In the embodiments described above, a serial type liquid ejecting apparatus 100 in which the transport member 242, on which the liquid ejecting head 26 is mounted, reciprocates is exemplified; however, the present invention can be applied to a line type liquid ejecting apparatus in which the plurality of nozzles N are arranged over the entire width of the medium 12.

(11) The liquid ejecting apparatus 100 exemplified in the embodiments described above can be employed in various types of machines such as a facsimile machine or a copy machine, in addition to a machine dedicated to printing. However, the use of the liquid ejecting apparatus of the present invention is not limited to the printing. For example, a liquid ejecting apparatus that ejects a solution of a color material is used as a manufacturing apparatus that forms a color filter of a liquid crystal display device. In addition, a liquid ejecting apparatus that ejects a solution of a conductive material is used as a manufacturing apparatus that forms a wiring or an electrode of the wiring substrate.

REFERENCE SIGNS LIST

100 LIQUID EJECTING APPARATUS
12 MEDIUM
14 LIQUID CONTAINER
20 CONTROL UNIT
22 TRANSPORT MECHANISM
24 MOVING MECHANISM
242 TRANSPORT MEMBER
244 TRANSPORT BELT
26 LIQUID EJECTING HEAD
28 WIRING SUBSTRATE
30 FLOW CHANNEL FORMING UNIT
32 FIRST FLOW CHANNEL SUBSTRATE
34 SECOND FLOW CHANNEL SUBSTRATE
42 VIBRATING UNIT
44 PIEZOELECTRIC ELEMENT
46 PROTECTIVE MEMBER
48 HOUSING
482 INTRODUCTION PORT
52 NOZZLE PLATE
54 VIBRATION ABSORBER
61 SUPPLY CHANNEL
63 COMMUNICATION CHANNEL
65 CIRCULATING LIQUID CHAMBER
65*a*, 65*b* CIRCULATION PORT
651 FIRST SPACE
652 SECOND SPACE
665 GROOVE
67 CIRCULATING LIQUID CHAMBER
69 PARTITION WALL
692 FLOW CHANNEL WALL
n1 FIRST ZONE
n2 SECOND ZONE
72 CIRCULATION CHANNEL
75 CIRCULATION MECHANISM

The invention claimed is:

1. A liquid ejecting head comprising:

a nozzle plate provided with a nozzle;

a flow channel forming unit provided with a pressure chamber to which a liquid is supplied, a communication channel through which the nozzle and the pressure chamber communicate with each other, and a circulating liquid chamber communicating with the communication channel; and a pressure generating unit that generates a pressure change in the pressure chamber, wherein a height at a first location in the circulating liquid chamber is larger than a height at a second location on a side of the communication channel when viewed from the first location, and wherein the circulating liquid chamber has an upper surface provided with a plurality of grooves extending into a curved shape in a plan view.

2. The liquid ejecting head according to claim 1, wherein the circulating liquid chamber does not overlap the pressure chamber in a plan view.

3. The liquid ejecting head according to claim 1, wherein a maximum value of the height of the circulating liquid chamber is smaller than a flow channel length of the communication channel.

4. The liquid ejecting head according to claim 1, wherein the flow channel forming unit has a first flow channel substrate provided with the communication channel and the circulating liquid chamber and a second flow channel substrate provided with the pressure chamber, and wherein a maximum value of the height of the circulating liquid chamber is equal to or smaller than a half of a thickness of the first flow channel substrate.

5. The liquid ejecting head according to claim 1, wherein a maximum value of the height of the circulating liquid chamber is smaller than a width of the circulating liquid chamber.

6. The liquid ejecting head according to claim 1, wherein the circulating liquid chamber elongates in a first direction, and wherein the plurality of grooves has a convex shape on a first side in the first direction in a plan view.

7. The liquid ejecting head according to claim 1, wherein the nozzle plate is provided with a first nozzle and a second nozzle as the nozzle, wherein the flow channel forming unit is provided with the pressure chamber and the communication channel corresponding to the first nozzle, the pressure chamber and the communication channel corresponding to the second nozzle, and the circulating liquid chamber that is positioned between the communication channel corresponding to the first nozzle and the communication channel corresponding to the second nozzle and that elongates in the first direction, and wherein the grooves formed in a region of the upper surface of the circulating liquid chamber on a side of the first nozzle have a convex shape on a first side in the first direction, and the grooves formed in a region on a side of the second nozzle have a convex shape on a second side opposite to the first side in a plan view.

8. The liquid ejecting head according to claim 1, wherein the nozzle plate is provided with a first nozzle and a second nozzle as the nozzle, wherein the flow channel forming unit is provided with the pressure chamber and the communication channel corresponding to the first nozzle, the pressure chamber and the communication channel corresponding to the second nozzle, and the circulating liquid chamber that is positioned between the communication channel corresponding to the first nozzle and the communication channel corresponding to the second nozzle and that elongates in the first direction, and wherein the grooves formed in a region of the upper surface of the circulating liquid chamber on a side of the first nozzle and the grooves formed in a region on a side of the second nozzle have a convex shape on a first side in the first direction in a plan view.

9. The liquid ejecting head according to claim 1, wherein the nozzle plate is provided with a plurality of nozzles arranged in the first direction, wherein the flow channel forming unit is provided with the pressure chamber and the communication channel corresponding to each of the plurality of nozzles and the circulating liquid chamber elongating in the first direction, and wherein grooves of the plurality of grooves which are positioned on a first side in the first direction have a convex shape on a second side opposite to the first side in a plan view, and grooves of the plurality of grooves on the second side in the first direction have a convex shape on the first side in a plan view.

10. The liquid ejecting head according to claim 1, wherein the flow channel forming unit is provided with a first circulating liquid chamber and a second circulating liquid chamber as the circulating liquid chamber, which are positioned on opposite sides of each other with the communication channel interposed therebetween and which communicate with the communication channel.

11. The liquid ejecting head according to claim 10, wherein the first circulating liquid chamber does not overlap the pressure chamber in a plan view, but the second circulating liquid chamber overlaps the pressure chamber in a plan view.

12. The liquid ejecting head according to claim 1, wherein the flow channel forming unit is provided with a liquid supply chamber that stores a liquid that is to be supplied to the pressure chamber, and wherein the maximum value of the height of the circulating liquid chamber is equal to a height of the liquid supply chamber.

13. The liquid ejecting head according to claim 1, wherein a partition wall having a predetermined thickness is provided between the circulating liquid chamber and the communication channel.

14. The liquid ejecting head according to claim 1, wherein the circulating liquid chamber has a first space and a second space formed between flow channel walls, which are opposite to each other, on a side of the communication channel when viewed from the first space, wherein the first location is positioned within the first space, and wherein the second location is positioned within the second space.

15. The liquid ejecting head according to claim 1, further comprising:

a wiring substrate having an end portion disposed on an opposite side of the nozzle plate with the flow channel forming unit interposed therebetween, and wherein the circulating liquid chamber overlaps the end portion of the wiring substrate in a plan view.

16. A liquid ejecting apparatus comprising:

the liquid ejecting head according to claim 1.

17. A liquid ejecting head comprising:

a nozzle plate provided with a nozzle;

a flow channel forming unit provided with a pressure chamber to which a liquid is supplied, a communication channel through which the nozzle and the pressure chamber communicate with each other, and a circulating liquid chamber communicating with the communication channel;

a pressure generating unit that generates a pressure change in the pressure chamber; and a circulation channel through which the communication channel and the circulating liquid channel communicate with each other, wherein a height at a first location in the circulating liquid chamber is larger than a height at a second location on a side of the communication channel when viewed from the first location, and wherein the circulation channel is formed on a surface of the nozzle plate.

18. The liquid ejecting head according to claim 17, wherein the circulating liquid chamber does not overlap the pressure chamber in a plan view.

19. The liquid ejecting head according to claim 17, wherein a maximum value of the height of the circulating liquid chamber is smaller than a flow channel length of the communication channel.

20. The liquid ejecting head according to claim 17, wherein the flow channel forming unit has a first flow channel substrate provided with the communication channel and the circulating liquid chamber and a second flow channel substrate provided with the pressure chamber, and wherein a maximum value of the height of the circulating liquid chamber is equal to or smaller than a half of a thickness of the first flow channel substrate.

* * * * *